US009289979B2

(12) United States Patent
Arimoto

(10) Patent No.: US 9,289,979 B2
(45) Date of Patent: Mar. 22, 2016

(54) ASSISTANCE DEVICE, DESIGN ASSISTANCE METHOD AND RECORDING MEDIUM FOR LIQUID EJECTION DEVICE, METHOD OF MANUFACTURING LIQUID EJECTION DEVICE, AND IMAGE RECORDING DEVICE

(71) Applicant: FUJIFILM Corporation, Tokyo (JP)

(72) Inventor: Makoto Arimoto, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/634,660

(22) Filed: Feb. 27, 2015

(65) Prior Publication Data

US 2015/0174897 A1 Jun. 25, 2015

Related U.S. Application Data

(63) Continuation of application No. PCT/JP2013/072982, filed on Aug. 28, 2013.

(30) Foreign Application Priority Data

Aug. 31, 2012 (JP) ..... 2012-191761

(51) Int. Cl.
*B41J 2/18* (2006.01)
*B41J 2/045* (2006.01)
*B41J 2/175* (2006.01)

(52) U.S. Cl.
CPC ..... *B41J 2/04541* (2013.01); *B41J 2/175* (2013.01); *Y10T 29/49401* (2015.01)

(58) Field of Classification Search
USPC ..... 347/6, 7, 85, 89
See application file for complete search history.

(56) References Cited

U.S. PATENT DOCUMENTS

| | | | | |
|---|---|---|---|---|
| 4,630,072 | A | 12/1986 | Scardovi et al. | |
| 2012/0024395 | A1 | 2/2012 | Furukawa et al. | |
| 2012/0026256 | A1 | 2/2012 | Shibata | |
| 2012/0050357 | A1 * | 3/2012 | Rasmussen | B41J 2/16526 347/6 |

FOREIGN PATENT DOCUMENTS

| | | | |
|---|---|---|---|
| JP | S60-171163 | A | 9/1985 |
| JP | 2008-304998 | A | 12/2008 |
| JP | 2012-030515 | A | 2/2012 |
| JP | 2012-030516 | A | 2/2012 |

OTHER PUBLICATIONS

International Search Report; PCT/JP2013/072982; Oct. 8, 2013.

* cited by examiner

*Primary Examiner* — Lam Nguyen
(74) *Attorney, Agent, or Firm* — Studebaker & Brackett PC

(57) ABSTRACT

A design assistance method for a liquid ejection device includes an acquiring step of acquiring a pulsation frequency $f_p$ of a liquid pressure applying unit, a compliance capacity C of a pressure absorber, and a composite inertance L of a liquid ejection head and a liquid supply flow channel; a determining step of determining whether a relationship between a cutoff frequency $f_c$ expressed by $f_c=1/(2\pi(LC)^{0.5})$ using the acquired C and L, and the pulsation frequency $f_p$ satisfies a predetermined relationship that satisfies $f_p \geq f_c$; and an outputting step of outputting a determination result in the determining step.

24 Claims, 12 Drawing Sheets

ASSISTANCE DEVICE, DESIGN ASSISTANCE METHOD AND RECORDING MEDIUM FOR LIQUID EJECTION DEVICE, METHOD OF MANUFACTURING LIQUID EJECTION DEVICE, AND IMAGE RECORDING DEVICE

CROSS-REFERENCE TO RELATED APPLICATIONS

This application is a Continuation of PCT International Application No. PCT/JP2013/072982 filed on Aug. 28, 2013, which claims priority under 35 U.S.C §119(a) to Japanese Patent Application No. 2012-191761 filed on Aug. 31, 2012. Each of the above applications is hereby expressly incorporated by reference, in their entirety, into the present application.

BACKGROUND OF THE INVENTION

1. Field of the Invention

The present invention relates to a design assistance device, a design assistance method and a recording medium for a liquid ejection device, a method of manufacturing a liquid ejection device and an image recording device, and more particularly to a technique of applying pressure fluctuation into a print head by using a pump to supply and circulate ink.

2. Description of the Related Art

In an ink jet recording device, stable supply of ink to a print head is required to accurately control the ejection of ink from nozzles of the print head, and the "stable" described herein means that pressure fluctuation is reduced as much as possible. The pressure fluctuation may affect image quality, concentration, and ink drop position accuracy.

In a case of an ink supply system by a water head method, there is no pressure fluctuation in feeding liquid itself. However, in a case where a pump method is adopted, there is a possibility that pressure largely varies due to pulsation caused by a pump, so that the pressure cannot be appropriately controlled.

As above, in the pump method, a frequency of a flow rate source of the pump is determined in accordance with a rotation speed of the pump. Thus, it is required to determine design values of a damper and a flow channel so that amplitude strength at a frequency at which predetermined pump drive is performed is sufficiently reduced.

In contrast, PTL 1 (Japanese Patent Application Laid-Open No. 60-171163) describes a technique in which there are provided a first portion including a piezoelectric converter for ejecting a droplet from a nozzle, and a second portion made of viscoelasticity material that absorbs energy of a pressure wave propagated in a duct, and in which the second portion is connected to a liquid pressure resistance to attenuate resonance of the duct at a frequency lower than a cutoff frequency, and a size of the second portion is adjusted to attenuate resonance of the duct at a frequency higher than the cutoff frequency.

SUMMARY OF THE INVENTION

However, in PTL 1, there is no description of flow channel parameters in a case where a pump and a sub tank (damper) are included. Thus, if a capacity of the damper provided in the sub tank arranged just in front of the pump or just behind the pump is not properly determined, pressure may not be efficiently reduced.

The present invention has been made in light of the above-mentioned circumstances, and it is an object to provide a design assistance device, a design assistance method and a recording medium for a liquid ejection device, a method of manufacturing a liquid ejection device, and an image recording device, which are capable of optimizing a flow channel configuration in accordance with a rotational frequency of a pump, or of setting a rotation speed of the pump in accordance with the flow channel configuration.

In order to achieve the object above, one aspect of a design assistance method for a liquid ejection device is a design assistance method of assisting design of a liquid ejection device that satisfies a predetermined relationship and that a liquid ejection head provided with a nozzle for ejecting liquid; a liquid supply flow channel configured to supply the liquid to the liquid ejection head; and a liquid pressure applying unit configured to apply pressure to the liquid in the liquid supply flow channel through a pressure absorber, the design assistance method including: an acquiring step of acquiring a pulsation frequency $f_p$ of the liquid pressure applying unit, a compliance capacity C of the pressure absorber, and a composite inertance L of the liquid ejection head and the liquid supply flow channel; a determining step of determining whether a relationship between a cutoff frequency $f_c$ expressed by $f_c=1/(2\pi(LC)^{0.5})$ using the acquired C and L, and the pulsation frequency $f_p$ satisfies the predetermined relationship that satisfies $f_p \geq f_c$; and an outputting step of outputting a determination result in the determining step.

According to the present aspect, it is determined whether the relationship between the $f_c$ and the $f_p$ satisfies the predetermined relationship that satisfies $f_p \geq f_c$, and the determination result is output to thereby assist design of the liquid ejection device that satisfies the predetermined relationship, so that it is possible to optimize a flow channel configuration in accordance with a rotational frequency of a pump, or to set a rotation speed of the pump in accordance with the flow channel configuration.

It is preferable that the predetermined relationship is a relationship of $f_p \geq mf_c$ (m is a constant greater than 1). Accordingly, it is possible to reduce pulsation of the pump, as well as to prevent resonance from occurring.

The acquiring step may include acquiring a composite resistance R of the liquid ejection head and the liquid supply flow channel, and the predetermined relationship may be a relationship as follows: $f_c \leq f_p < mf_c$ (m is the constant greater than 1), and a damping term $\zeta$ expressed by $\zeta=0.5R(C/L)^{0.5}$ and satisfying $\zeta>1$. Accordingly, it is possible to reduce pulsation of the pump, as well as to prevent resonance from occurring.

In addition, it is preferable that m is 2. Accordingly, it is possible to properly reduce pulsation of the pump, as well as to prevent resonance from occurring.

It is preferable that the design assistance method for the liquid ejection device includes the steps of: acquiring a primary design of a flow channel configuration of the liquid ejection device; and calculating the compliance capacity C, the composite resistance R, and the composite inertance L from the acquired primary design of the flow channel configuration, and wherein the outputting step includes providing an output for urging at least one of values of the compliance capacity C and the composite inertance L to be changed if it is determined in the determining step that the relationship between the cutoff frequency $f_c$ and the pulsation frequency $f_p$ indicates $f_p<f_c$, and providing an output for urging a value of the composite resistance R to be increased if it is determined in the determining step that the relationship between the cutoff frequency $f_c$ and the pulsation frequency $f_p$ indicates $f_c \leq f_p \leq mf_c$ and $\zeta \leq 1$. Accordingly, it is possible to properly change the acquired primary design.

The design assistance method for the liquid ejection device may include the steps of: acquiring an estimated liquid consumption of the liquid ejection head; and calculating the pulsation frequency $f_p$ of the liquid pressure applying unit from the acquired estimated liquid consumption. Accordingly, it is possible to properly calculate the pulsation frequency $f_p$.

It is preferable that the outputting step includes outputting the pulsation frequency $f_p$ that satisfies $f_c \leq f_p$ if it is determined in the determining step that $\zeta > 1$ is satisfied, and outputting the pulsation frequency $f_p$ that satisfies $mf_c \leq f_p$ if it is determined in the determining step that $\zeta \leq 1$ is satisfied. Accordingly, it is possible to reduce pulsation of the pump, and to prevent resonance from occurring.

The design assistance method for the liquid ejection device may include the steps of: acquiring the flow channel configuration of the liquid ejection device; and calculating the compliance capacity C, the composite resistance R, and the composite inertance L, from the acquired flow channel configuration. Accordingly, it is possible to properly change the acquired flow channel configuration.

The outputting step may include calculating and outputting a value satisfying the predetermined relationship for at least one of the $f_c$, the C, and the L if it is determined in the determining step that the predetermined relationship is not satisfied. Accordingly, it is possible to recognize conditions satisfying the predetermined relationship.

It is preferable that the pressure absorber includes a liquid chamber that communicates with the liquid supply flow channel; and a gas chamber that is separated from the liquid chamber with a partition wall deformable or movable for making a volume of the liquid chamber changeable. Accordingly, it is possible to properly reduce pulsation of the pump.

It is preferable that the liquid ejection device further includes a liquid recovering flow channel configured to recover the liquid from the liquid ejection head; and a second liquid pressure applying unit configured to apply pressure to the liquid in the liquid recovering flow channel through a second pressure absorber, the acquiring step includes acquiring a pulsation frequency $f_{p2}$ of the second liquid pressure applying unit, a compliance capacity $C_2$ of the second pressure absorber, and the composite inertance L of the liquid ejection head, the liquid supply flow channel, and the liquid recovering flow channel, and that the determining step includes determining whether a relationship between a cutoff frequency $f_{c2}$ expressed by $f_{c2}=1/(2\pi(LC_2)^{0.5})$ using the acquired $C_2$ and L, and the pulsation frequency $f_{p2}$ satisfies a second relationship that satisfies $f_{p2} \geq f_{c2}$. Accordingly, it is possible to reduce pulsation of the pump for recovering liquid, and to prevent resonance from occurring.

It is preferable that the second relationship is a relationship of $f_{p2} \geq nf_{c2}$ (n is a constant greater than 1). Accordingly, it is possible to reduce pulsation of a recovery-side pump, and to prevent resonance from occurring.

The acquiring step may include acquiring the composite resistance R of the liquid ejection head and the liquid supply flow channel, and the predetermined relationship may be a relationship as follows: $f_{c2} \leq f_{p2} < nf_{c2}$ (n is a constant greater than 1), and a damping term $\zeta_2$ expressed by $\zeta=0.5R(C_2/L)^{0.5}$, and satisfying $\zeta_2 > 1$. Accordingly, it is possible to reduce pulsation of the recovery-side pump, and to prevent resonance from occurring.

In addition, it is preferable that n is 2. Accordingly, it is possible to properly reduce pulsation of the recovery-side pump, and to prevent resonance from occurring.

It is preferable that the design assistance method for the liquid ejection device further includes the steps of: acquiring the primary design of a flow channel configuration of the liquid ejection device; and calculating the compliance capacity $C_2$, the composite resistance R, and the composite inertance L from the acquired primary design of the flow channel configuration, and that the outputting step includes providing an output for urging at least one of values of the compliance capacity $C_2$ and the composite inertance L to be changed if it is determined in the determining step that the relationship between the cutoff frequency $f_{c2}$ and the pulsation frequency $f_{p2}$ indicates $f_{p2} < f_{c2}$ in the determining step, and providing an output for urging a value of the composite resistance R to be increased if it is determined in the determining step that the relationship between the cutoff frequency $f_{c2}$ and the pulsation frequency $f_{p2}$ indicates $f_{c2} \leq f_{p2} < nf_{c2}$, and $\zeta \leq 1$. Accordingly, it is possible to properly change the acquired primary design.

The design assistance method for the liquid ejection device may include the steps of acquiring an estimated amount of recovered liquid of the liquid ejection head; and calculating the pulsation frequency $f_{p2}$ of the second liquid pressure applying unit from the acquired estimated amount of recovered liquid. Accordingly, it is possible to properly calculate the pulsation frequency $f_{p2}$ of the recovery-side pump.

It is preferable that the outputting step includes outputting the pulsation frequency $f_{p2}$ that satisfies $f_{c2} \leq f_{p2}$ if it is determined in the determining step that $\zeta_2 > 1$ is satisfied, and outputting the pulsation frequency $f_{p2}$ that satisfies $2f_{c2} \leq f_{p2}$ if it is determined in the determining step that $\zeta_2 \leq 1$ is satisfied. Accordingly, it is possible to reduce pulsation of the pump, and to prevent resonance from occurring.

The design assistance method for the liquid ejection device may include the steps of: acquiring the flow channel configuration of the liquid ejection device; and calculating the compliance capacity $C_2$, the composite resistance R, and the composite inertance L, from the acquired flow channel configuration. Accordingly, it is possible to properly change the acquired flow channel configuration.

The outputting step may include calculating and outputting a value satisfying the second relationship for at least one of the $f_{c2}$, the $C_2$, and the L if it is determined in the determining step that the predetermined relationship is not satisfied. Accordingly, it is possible to recognize conditions satisfying the second relationship.

It is preferable that the second pressure absorber includes a second liquid chamber that communicates with the liquid recovering flow channel; and a second gas chamber that is separated from the second liquid chamber with a second partition wall deformable or movable for making a volume of the second liquid chamber changeable. Accordingly, it is possible to properly reduce pulsation of the pump.

In order to achieve the object above, one aspect of a design support program of the liquid ejection device allows a computer to execute each of the steps of the design assistance method of the liquid ejection device described above.

In order to achieve the object above, one aspect of a design assistance device for a liquid ejection device is a design assistance device for a liquid ejection device that satisfies a predetermined relationship and that includes a liquid ejection head provided with a nozzle for ejecting liquid; a liquid supply flow channel configured to supply the liquid to the liquid ejection head; and a liquid pressure applying unit configured to apply pressure to liquid in the liquid supply flow channel through a pressure absorber, the design assistance device including: an acquisition unit configured to acquire a pulsation frequency $f_p$ of the liquid pressure applying unit, a compliance capacity C of the pressure absorber, and a composite inertance L of the liquid ejection head and the liquid supply flow channel; a determination unit configured to determine whether a relationship between a cutoff frequency $f_c$ expressed by $f_c=1/(2\pi(LC)^{0.5})$ using the acquired C and L, and the pulsation frequency $f_p$ satisfies the predetermined relationship that satisfies $f_p \geq f_c$; and an output unit configured to output a determination result of the determination unit. Accordingly, it is possible to assist design of the liquid ejection device in which pulsation of the pump is reduced and resonance does not occur.

In order to achieve the object above, one aspect of a method of manufacturing a liquid ejection device that satisfies a predetermined relationship and that includes a liquid ejection head provided with a nozzle for ejecting liquid; a liquid supply flow channel configured to supply the liquid to the liquid ejection head; and a liquid pressure applying unit configured to apply pressure to the liquid in the liquid supply flow channel through a pressure absorber, the method including: an acquiring step of acquiring a pulsation frequency $f_p$ of the liquid pressure applying unit, a compliance capacity C of the pressure absorber, and a composite inertance L of the liquid ejection head and the liquid supply flow channel; a determining step of determining whether a relationship between a cutoff frequency $f_c$ expressed by $f_c=1/(2\pi(LC)^{0.5})$ using the acquired C and L, and the pulsation frequency $f_p$ satisfies the predetermined relationship that satisfies $f_p \geq f_c$, outputting the $f_p$, the C, and the L, if it is determined that the predetermined relationship is satisfied, and calculating and outputting a value satisfying the predetermined relationship for at least one of the $f_c$, the C, and the L if it is determined that the predetermined relationship is not satisfied; and a designing step of designing the liquid ejection device based on the output $f_c$, C, and L.

In order to achieve the object above, one aspect of an image recording device includes: a liquid ejection device manufactured by the method of manufacturing a liquid ejection device; a moving unit configured to relatively move the liquid ejection head and a recording medium; and a control unit configured to control the liquid to be ejected from the nozzle so that an image is formed on a recording surface of the recording medium while relatively moving the liquid ejection head and the recording medium.

The present invention enables the flow channel configuration to be optimized in accordance with the rotational frequency of the pump, or enables the rotation speed of the pump to be set in accordance with the flow channel configuration.

DETAILED DESCRIPTION OF EXEMPLARY EMBODIMENTS

With reference to accompanying drawings, preferable embodiments of the present invention will be described in detail.

First Embodiment

Flow Channel Configuration in Non-Circulation Type Print Head

Figure 1:
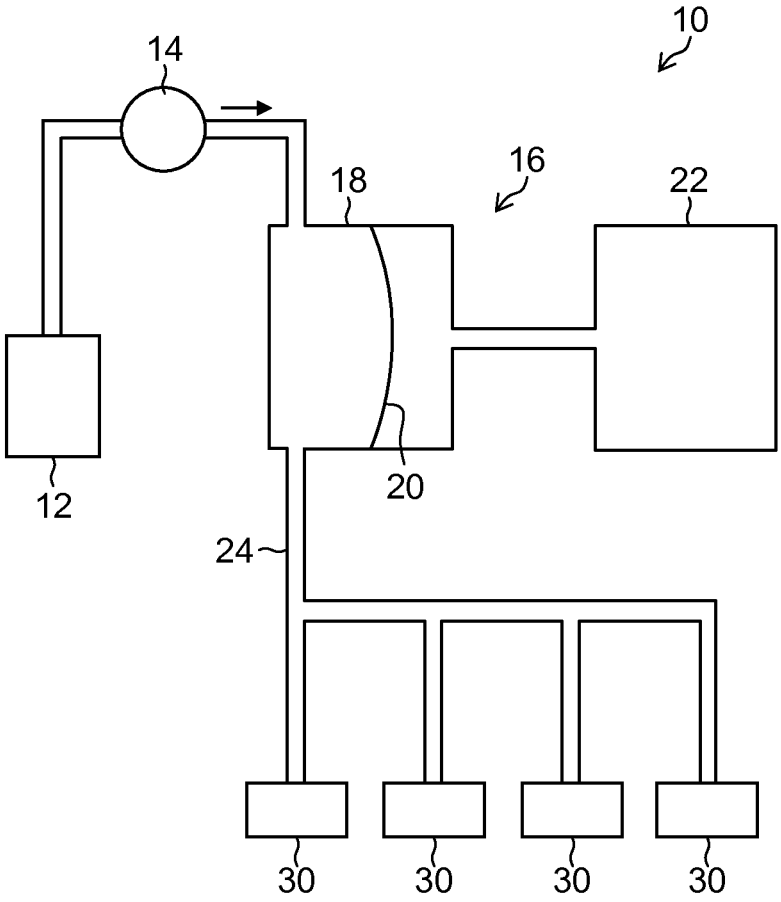
FIG. 1 is a schematic diagram of a liquid supply device that feeds ink to a non-circulation type print head.

FIG. 1 schematically illustrates a liquid ejection device provided with a non-circulation type print head. As illustrated in the figure, a liquid ejection device 10 includes a main tank 12, a pump 14, a pump damper 16, a tube 24, and a plurality of non-circulation type print heads 30 (an example of a liquid ejection head, hereinafter, "print head 30").

The main tank 12 is connected to the pump 14 (an example of liquid pressure applying unit). The pump 14 supplies ink stored in the main tank 12 to the print heads 30 through the pump damper 16 and the tube 24.

The pump damper 16 (an example of a pressure absorber) includes a liquid chamber 18 in and out of which ink flows, and an air chamber 22 provided so as to face the liquid chamber 18 across a flexible film 20. The flexible film 20 is configured to be deformable or movable to make a volume of the liquid chamber changeable. The pump damper 16 absorbs pressure fluctuation occurring in ink in the liquid chamber 18 with the flexible film 20 and the air chamber 22 by setting the inside of the air chamber 22 at a predetermined pressure to reduce pulsation of the pump 14.

The pump damper 16 is connected to the print head 30 through the tube 24 (an example of a liquid supply flow channel).

The print head 30 is provided with a plurality of nozzles each of which ejects ink. Hereinafter, an example in which a plurality of print heads is connected will be described; however, a single print head or a plurality of print heads provided in parallel may be applicable.

Figure 2:
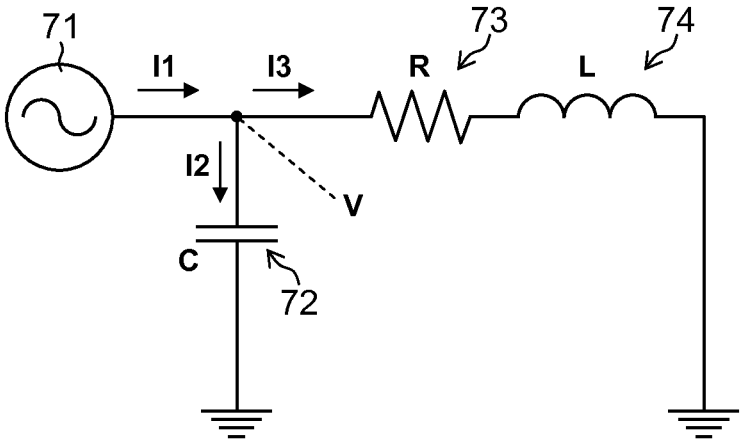
FIG. 2 is a circuit diagram illustrating an equivalent circuit of an ink flow channel of the liquid supply device.

FIG. 2 is a circuit diagram illustrating an equivalent circuit modeling the ink flow channel of the liquid ejection device 10 illustrated in FIG. 1 as an audio circuit model. In the figure, an alternate current source 71 corresponds to the pump 14. In addition, in a case where the print head 30 ejects ink, a capacitance C of a capacitor 72 corresponds to a capacity (a compliance component in audio engineering) of the pump damper 16, and an electric resistance R of a resistance 73 and an inductance L of a coil 74 correspond to an audio resistance and an inertial component (inertance), respectively, of each of the tube 24 and print head 30. In a case where a plurality of the print heads 30 are connected, the audio resistance and the inertial component correspond to a combined audio resistance and a combined inertial component of the print heads 30, respectively.

As illustrated in FIG. 2, an ink flow rate from the pump 14, an ink flow rate to the pump damper 16 (liquid chamber 18), and an ink flow rate to the tube 24 and the print head 30, are indicated as $I_1$, $I_2$, and $I_3$, respectively.

Since a relationship of the flow rates is as follows: $I_1=I_2+I_3$, a relationship to be satisfied is given as below from the relationship of the flow rates and a relationship of a pressure V.

$$(I_1-I_3)\times 1/sC=(sL+R)I_3 \quad \text{(expression 1)}$$

The expression 1 is modified as follows:

$$I_3/I_1=1/(CLs^2+CRs+1) \quad \text{(expression 2)}$$

where s is a Laplace variable.

The expression 2 shows a frequency response to an ink flow rate (secondary low-pass filter), so that it is required to sufficiently satisfy a damping of a vibration amplitude in a pulsation frequency of the pump 14 to be used.

In addition, a normal transmission function of a secondary system is expressed as follows:

$$G(s)=\omega_n^2/(s^2+2\zeta\omega_n s+\omega_n^2) \quad \text{(expression 3)}$$

where $\zeta$ is a damping term, and the $\omega_n$ is a cutoff angle frequency (unit: rad/s), and comparing the expression 2 and the expression 3 shows an expression as follows:

$$\omega_n=1/(LC)^{0.5} \quad \text{(expression 4)}$$

Thus, a cutoff frequency derived from the transmission function of the expression 2 is expressed as follows:

$$f_c=\omega_n/2\pi=1/(2\pi(LC)^{0.5}) \quad \text{(expression 5)}$$

That is, the pulsation frequency $f_p$ and the cutoff frequency $f_c$ of the pump 14 may satisfy the relationship as follows: $f_c \leq f_p$.

In a case where the pulsation frequency $f_p$ and the cutoff frequency $f_c$ of the pump 14 are close to each other (such as $0.5f_c<f_p<2f_c$), resonance may occur depending on flow channel parameters. Thus, it is preferable that the pulsation frequency $f_p$ is sufficiently larger than the cutoff frequency, and preferable to satisfy a relationship of $m\times f_c \leq f_p$ (m is a constant greater than 1), for example. It is possible to indicate m as 2, for example.

Figure 3:
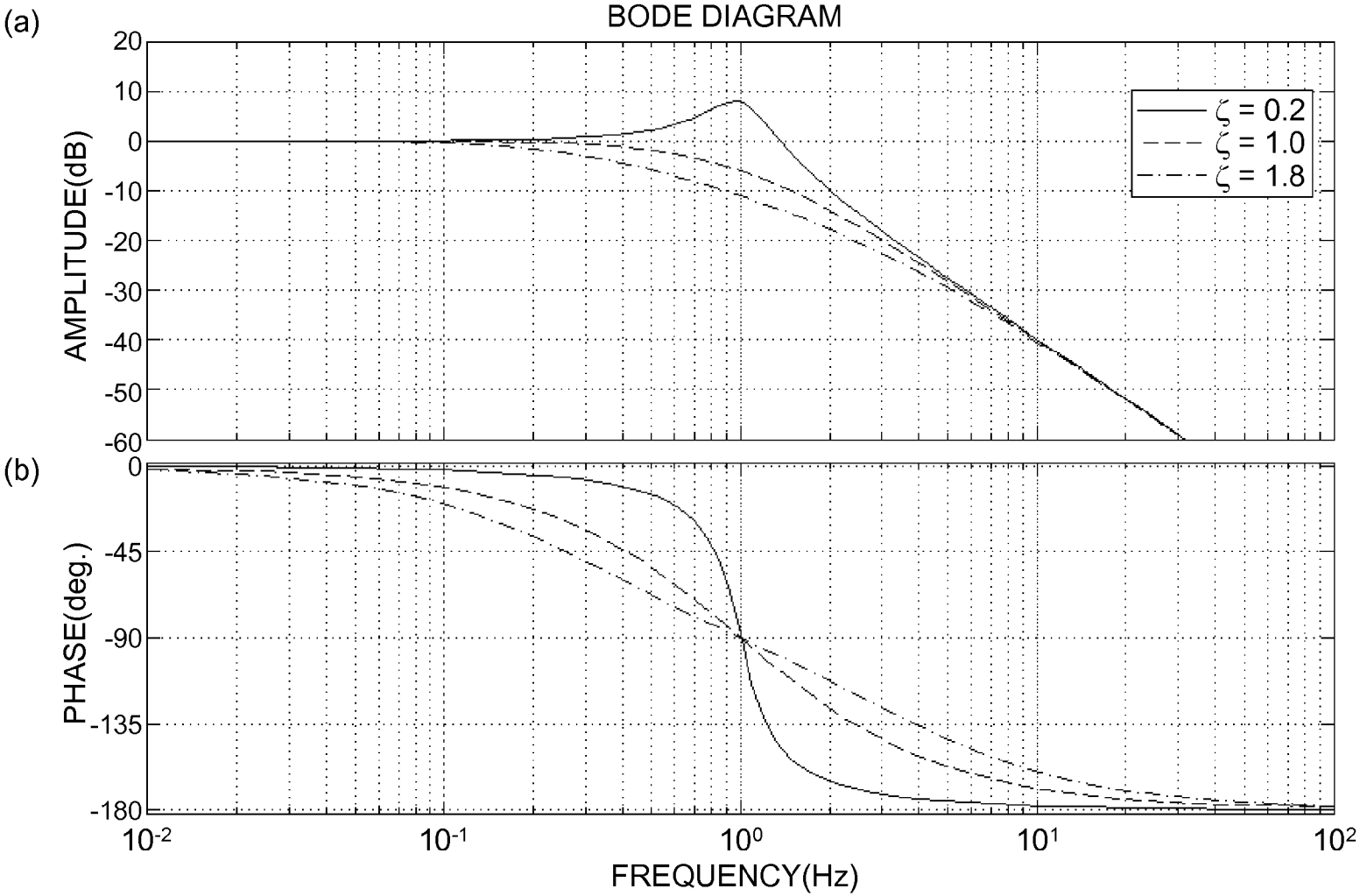
FIG. 3 is a Bode diagram illustrating an example of characteristics of a secondary low-pass filter.

FIG. 3 is a Bode diagram illustrating an example of characteristics of a secondary low-pass filter. FIG. 3 includes a portion (a) that is a Bode diagram illustrating characteristics of an amplitude (unit: dB) with respect to change in a pulsation frequency (unit: Hz) of the pump, and includes a portion (b) that is a Bode diagram illustrating characteristics of a phase (unit: deg) with respect to the change in the pulsation frequency (unit: Hz) of the pump. Here, the Bode diagram illustrates a case where the cutoff frequency is 1 (Hz), and a solid line, a broken line, and a dashed line show an under damping response ($\zeta$=0.2), a critical damping response ($\zeta$=1.0), and an over damping response ($\zeta$=1.8), respectively.

For example, in case where the damping term $\zeta$ is expressed as follows:

$$\zeta=0.5R(C/L)^{0.5} \quad \text{(expression 6)}$$

if the $\zeta$ is 0.2 or less, a resonance phenomenon may occur at a frequency near the cutoff frequency.

Thus, in a case where a relationship of the pulsation frequency $f_p$ and the cutoff frequency $f_c$ of the pump 14 satisfies the following relationship, $f_c<f_p<m\times f_c$, it is possible to sufficiently reduce pulsation of the pump 14 by determining a flow channel configuration so that $\zeta$ is as follows: $\zeta>1.0$.

Second Embodiment

Flow Channel Configuration in Non-Circulation Type Print Head

Figure 4:
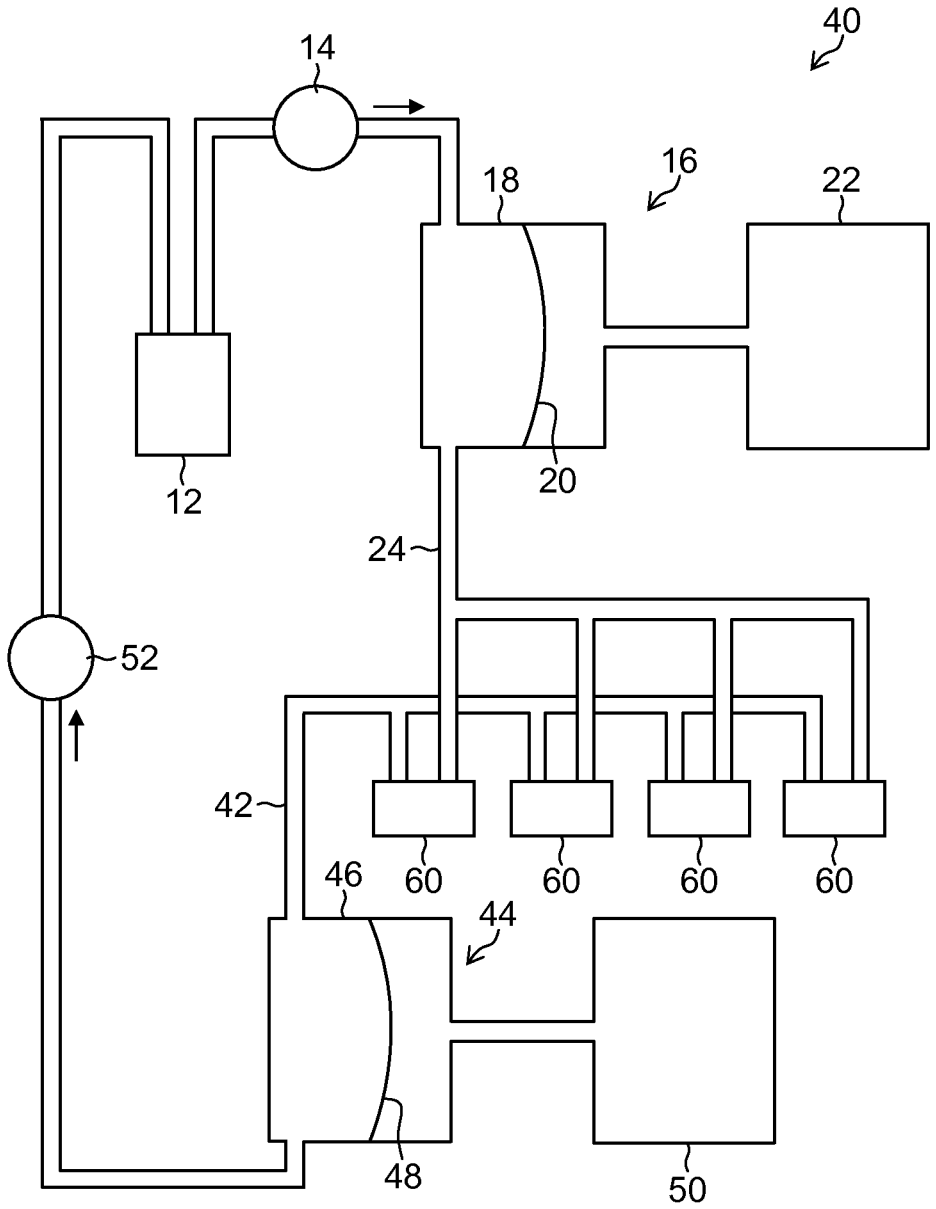
FIG. 4 is a schematic diagram of a liquid supply device that feeds ink to a circulation type print head.

FIG. 4 schematically illustrates a liquid ejection device provided with a circulation type print head. With respect to portions common to the schematic diagram illustrated in FIG. 1, the same reference numeral as that of FIG. 1 is applied to each of the portions to omit a detailed description of the portion.

As illustrated in the figure, a liquid ejection device 40 includes a recovery-side tube 42, a recovery-side pump damper 44, a recovery-side pump 52, a plurality of circulation type print heads 60 (hereinafter, "print heads 60"), as well as the main tank 12, the pump (supply-side pump) 14, the pump damper (supply-side pump damper) 16, and the tube (supply-side tube) 24. As with the liquid ejection device 10, a single print head or a plurality of print heads provided in parallel may be applicable.

The supply-side tube 24 and the recovery-side tube 42 (an example of a liquid recovering flow channel) communicate with each other through the circulation type print heads 60. In addition, the recovery-side tube 42 is connected to the recovery-side pump damper 44, the recovery-side pump damper 44 is connected to the recovery-side pump 52.

As with the liquid ejection device 10, the supply-side pump 14 supplies ink to the print heads 60. Here, the recovery-side pump 52 (second liquid pressure applying unit) recovers ink that is not ejected from the print heads 60 to the main tank 12 through the recovery-side tube 42 and the recovery-side pump damper 44.

The recovery-side pump damper 44 (an example of a second pressure absorber) includes a liquid chamber 46 in and out of which ink flows, and an air chamber 50 provided so as to face the liquid chamber 46 across a flexible film 48. The flexible film 48 is configured to be deformable or movable to make a volume of the liquid chamber changeable. The recovery-side pump damper 44 absorbs pressure fluctuation occurring in ink in the liquid chamber 46 with the flexible film 48 and the air chamber 50 by setting the inside of the air chamber 50 at a predetermined pressure to reduce pulsation of the recovery-side pump 52.

Figure 5:
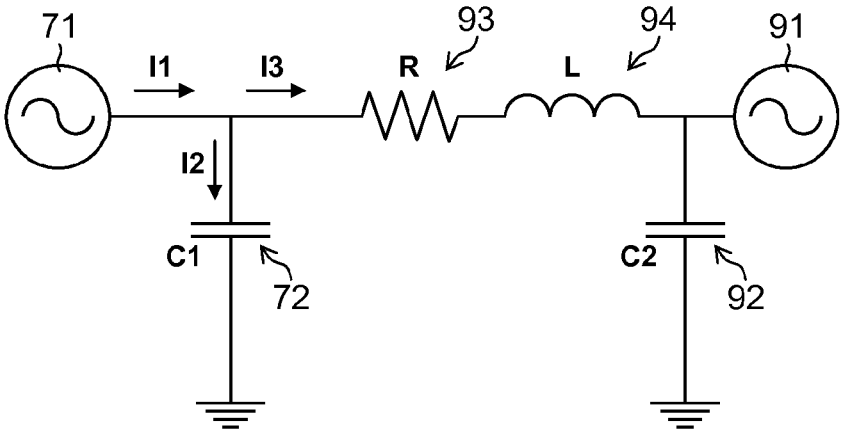
FIG. 5 is a circuit diagram illustrating an equivalent circuit of an ink flow channel of the liquid supply device.

FIG. 5 is a circuit diagram illustrating an equivalent circuit modeling the ink flow channel of the liquid ejection device 40 illustrated in FIG. 4 as an audio circuit model. In the figure, an alternating current source 71 and an alternating current source 91 correspond to the supply-side pump 14 and the recovery-side pump 52, respectively. In addition, a capacitance $C_1$ of a capacitor 72 and a capacitance $C_2$ of a capacitor 92 correspond to a capacity (a compliance component in audio engineering) of the supply-side pump damper 16 and a capacity of the recovery-side pump damper 44, respectively, and an electric resistance R of a resistance 93 and an inductance L of a coil 94 correspond to an audio resistance and an inertance component, respectively, of each of the supply-side tube 24, the print head 60, and the recovery-side tube 42.

Figure 6A:
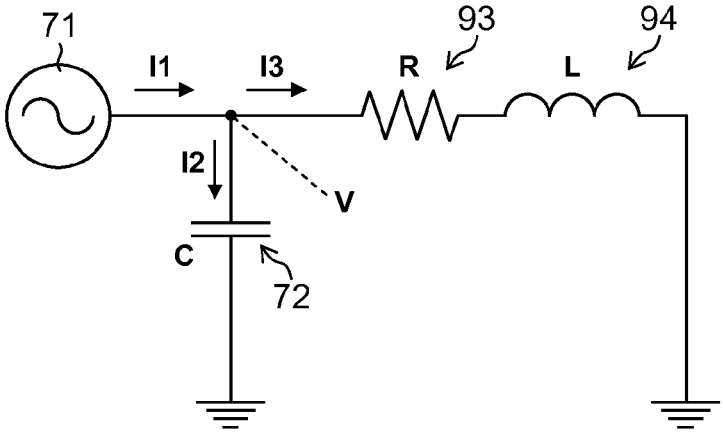
FIG. 6A is a circuit diagram illustrating an equivalent circuit of an ink flow channel of the liquid supply device.
Figure 6B:
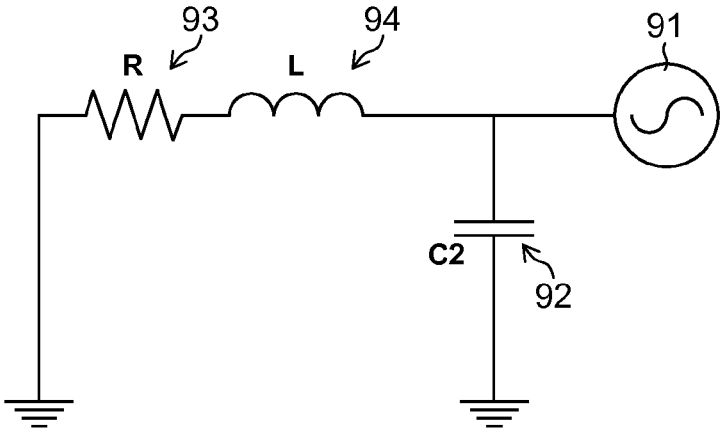
FIG. 6B is a circuit diagram illustrating an equivalent circuit of an ink flow channel of the liquid supply device.

In this case, influence of a frequency response given to the entire system by the supply-side pump 14 and the recovery-side pump 52 can be modeled by being approximated to the two states as illustrated in FIGS. 6A and 6B.

FIG. 6A illustrates an equivalent circuit that illustrates a frequency response of pulsation of the supply-side pump 14, and FIG. 6B illustrates an equivalent circuit that illustrates a frequency response of pulsation of the recovery-side pump 52.

Cutoff frequencies of the supply-side pump 14 and the recovery-side pump 52 are expressed, respectively as follows:

$$f_{c1}=\omega_n/2\pi=1/(2\pi(LC_1)^{0.5}) \quad \text{(expression 7)}$$

$$f_{c2}=\omega_n/2\pi=1/(2\pi(LC_2)^{0.5}) \quad \text{(expression 8).}$$

Thus, the pulsation frequencies $f_{p1}$, and $f_{p2}$, and the cutoff frequencies $f_{c1}$, and $f_{c2}$ may satisfy a relationship of $f_c \leq f_{p1}$, and $f_c \leq f_{p2}$, respectively. In addition, it is preferable to satisfy a relationship of each of $m \times f_{c1} \leq f_{p1}$, and $n \times f_{c2} \leq f_{p2}$ (each of m and n is a constant greater than 1) to prevent resonance. It is possible to indicate m as 2, and n as 2, for example.

In addition, in a case where a relationship is as follows: $f_{c1} < f_{p1} < m \times f_{c1}$, $\zeta_1$ may be as follows: $\zeta_1 > 1.0$, and in a case where a relationship is as follows: $f_{c2} < f_{p2} < m \times f_{c2}$, $\zeta_2$ may be as follows: $\zeta_2 > 1.0$.

Third Embodiment

Next, a design assistance method for assisting design of an optimum flow channel configuration in accordance with a frequency of a pump will be described.

Figure 7:
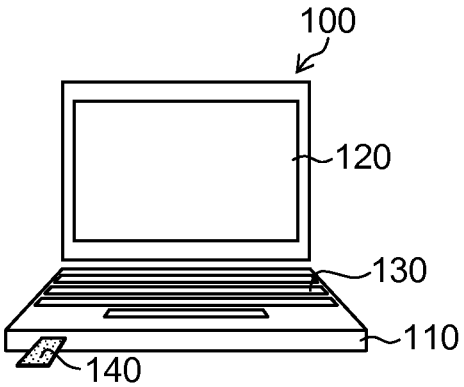
FIG. 7 is an external view of a design assistance device.

FIG. 7 illustrates an appearance of a design assistance device 100 in accordance with the present embodiment. As illustrated in FIG. 7, the design assistance device 100 is a personal computer, and includes a body unit 110 that performs calculation processing, a monitor 120 in which a calculation processing content is to be displayed, and a keyboard 130 with which an instruction of a user and character information are to be inputted, and a detachable recording medium 140 storing an executable program, and the like are connectable to the personal computer.

Figure 8:
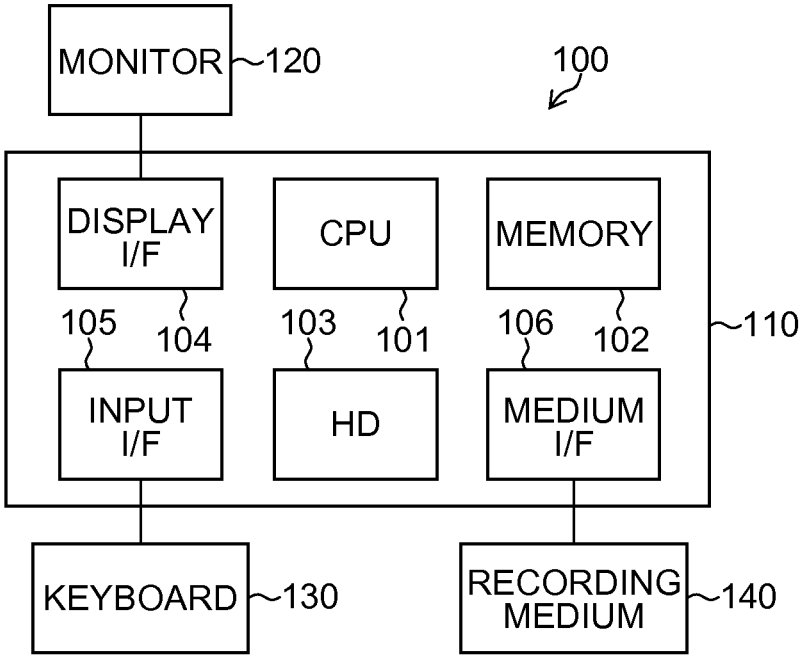
FIG. 8 is a block diagram of the design assistance device.

FIG. 8 is a block diagram illustrating an electrical configuration of the design assistance device 100. As illustrated in the figure, the body unit 110 includes a display interface 104 that outputs display information to the monitor 120, an input interface 105 that receives operation information from the keyboard 130, and a medium interface 106 that performs input and output of control information to/from the recording medium 140 in addition to a CPU 101, a memory 102, and a hard disk 103.

Figure 9:
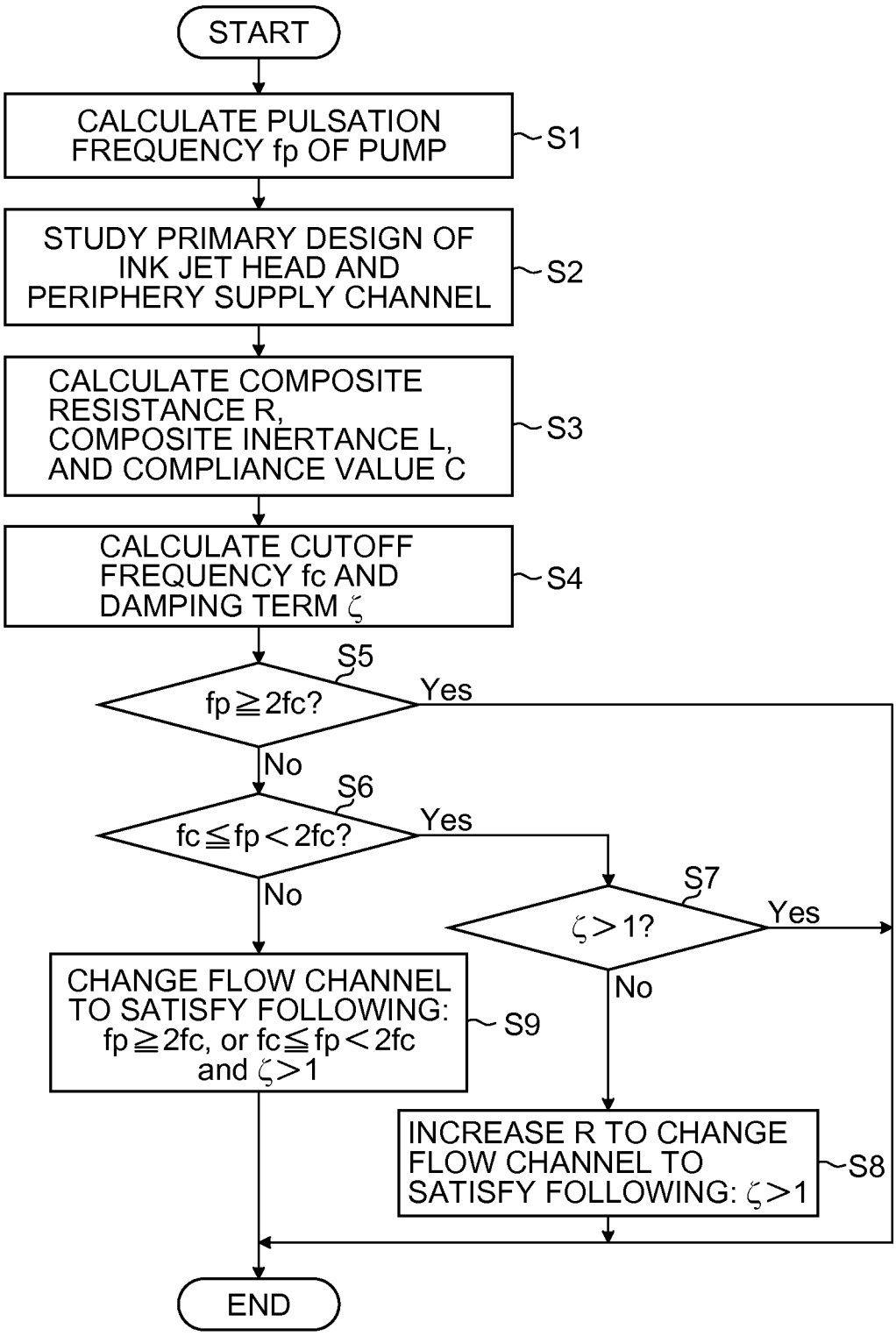
FIG. 9 is a flow chart illustrating processing of designing an optimum flow channel configuration.

FIG. 9 is a flow chart illustrating a design assistance method in accordance with the present embodiment. In the present embodiment, an optimum ink supply flow channel is designed in accordance with a frequency of a pump. The recording medium (such as a non-transitory recording medium) 140 stores a program for allowing a computer to execute processing in accordance with the design assistance method. The design assistance device 100 reads out the program from the recording medium 140 connected to a connector (not illustrated) of the body unit 110, and executes the program. The program may be stored in a hard disk built in the body unit 110, or may be read into the design assistance device 100 through a wired or wireless local area network (LAN), an infrared data association (IrDA), Bluetooth (registered trademark), and the like.

(Step S1)

A rotation speed of a pump is determined from an estimated ink consumption and the amount of ink circulation of a print head to be used to calculate a pulsation frequency $f_p$ of the pump in accordance with the rotation speed.

(Step S2)

A primary design of a supply flow channel of ink is studied from the print head and the pump to the print head to input the determined primary design to the design assistance device 100 (an example of a step of acquiring a primary design).

(Step S3)

Based on flow channel parameters in the primary design of the supply flow channel studied in the step S2, a composite resistance R, a composite inertance L, and a compliance value C of the supply flow channel are calculated (an example of an acquisition step and a calculation step).

For example, in a case where an inner diameter of the flow channel of the supply flow channel is indicated as r (m) and a length of the flow channel is indicated as 1 (m), and then viscous resistance of ink flowing in the supply flow channel is indicated as η (Pa·s), the flow channel resistance R can be derived as follows:

$$R\ (\text{Pa·s/m}^3)=128l\eta/(\pi r^4) \quad \text{(expression 9).}$$

In addition, in a case where the inner diameter of the flow channel of the supply flow channel is indicated as the r (m) and the length of the flow channel is indicated as the 1 (m), and then density of the ink flowing in the supply flow channel is indicated as ρ (kg/m$^3$), the inertance L can be derived as follows:

$$L\ (\text{kg/m}^4)=\rho l/(\pi r^2) \quad \text{(expression 10).}$$

Further, in a case where pressure is buffered by an elastic body, the compliance can be calculated from an elastic modulus. For example, in a case where volume of the damper is indicated as V (m$^3$), and the elastic modulus is indicated as κ (Pa), the compliance C can be derived as follows:

$$C=(\text{m}^3/\text{Pa})=V/\kappa \quad \text{(expression 11).}$$

There is also a case where it is impossible to derive the characteristics by generalizing the characteristics due to an extremely complex shape of the flow channel. In this case, the composite resistance R, the composite inertance L, and the compliance value C, may be derived by using a measured value.

(Step S4)

From values of L, R, and C, calculated in the step S3, a cutoff frequency $f_c$ and a damping term ζ of a supply system of the ink is calculated by using the expressions 5 and 6 described above.

(Step S5)

Next, it is determined whether the pulsation frequency $f_p$ of the pump calculated in the step S1 and the cutoff frequency $f_c$ of the supply system of the ink calculated in the step S4 satisfy a relationship as follows: $f_p \geq f_c$ (an example of determining step). In the present embodiment, it is determined whether to satisfy particularly the relationship as follows: $f_p \geq mf_c$, or the relationship as follows: $f_c \leq f_p < mf_c$, and $\zeta > 1$, in the relationship as follows: $f_p \geq f_c$. The present embodiment is described by using m that is 2.

First, it is determined whether to satisfy a relationship as follows: $f_p \geq 2f_c$. If the relationship is satisfied, it is possible to reduce pulsation of the pump, so that resonance does not occur. Thus, it is determined that there is no problem in a print head and a periphery supply channel of the primary design, so that processing is ended. If the relationship is not satisfied, the processing proceeds to step S6.

(Step S6)

If the relationship as follows: $f_p \geq 2f_c$, is not satisfied, it is determined whether to satisfy a relationship as follows: $f_c \leq f_p < 2f_c$. If the relationship is satisfied, the processing proceeds to step S7, and if the relationship is not satisfied, the processing proceeds to step S9.

(Step S7)

If the relationship as follows: $f_c \leq f_p < 2f_c$, is satisfied, next, it is determined whether to satisfy a relationship as follows: $\zeta > 1$. If the relationship is satisfied, it is possible to reduce pulsation of the pump, so that resonance does not occur. Thus, it is determined that there is no problem in a print head and a periphery supply channel of the primary design, so that processing is ended. If the relationship is not satisfied, the processing proceeds to step S8.

(Step S8)

In a case as follows: $f_c \leq f_p < 2f_c$, and $\zeta \leq 1$, resonance occurs, so that it is impossible to reduce pulsation. Thus, a warning to increase the composite resistance R from the primary design to allow $\zeta$ to be as follows: $\zeta > 1$, is displayed in the monitor 120. A user finds the warning and can change the flow channel from the primary design so that the composite resistance R increases.

In addition, a value of the composite resistance R allowing $\zeta$ to satisfy $\zeta > 1$, may be displayed. In this case, the user can change the primary design so that the composite resistance R is equal to the displayed value.

(Step S9) In a case as follows: $f_p < f_c$, it is impossible to reduce pulsation. Thus, a warning to change a value of at least one of the composite inertance L and the compliance value C to satisfy a relationship as follows: $f_p \geq 2f_c$, or $f_p \leq f_c < mf_c$ and $\zeta > 1$, is displayed in the monitor 120. The user finds the warning and can change the flow channel from the primary design so that the value of at least one of the composite inertance L and the compliance value C is changed.

In addition, the value of at least one of the composite inertance L and the compliance value C for satisfying the relationship as follows: $f_p \geq 2f_c$, or $f_c \leq f_p < mf_c$ and $\zeta > 1$ may be displayed. In this case, the user can change the primary design so that the value of the composite inertance L or the compliance value C is equal to the displayed value.

Here, the liquid ejection device 10 provided with the non-circulation type print head illustrated in FIG. 1 is described; however, the present embodiment is also applicable to the liquid supply device provided with the supply-side pump and the recovery-side pump illustrated in FIG. 4. In this case, it is possible to optimize a supply channel and a recovery channel by applying the processing illustrated in FIG. 9 to each of the pumps by using the equivalent circuit illustrated in FIG. 6.

The liquid ejection device is designed (an example of a design step) based on flow channel parameters designed by the design assistance method of the present embodiment, and the designed liquid ejection device is manufactured (an example of a manufacturing method of a liquid ejection device), so that it is possible to acquire a liquid ejection device in which pulsation of the pump is reduced and resonance does not occur.

Fourth Embodiment

Figure 10:
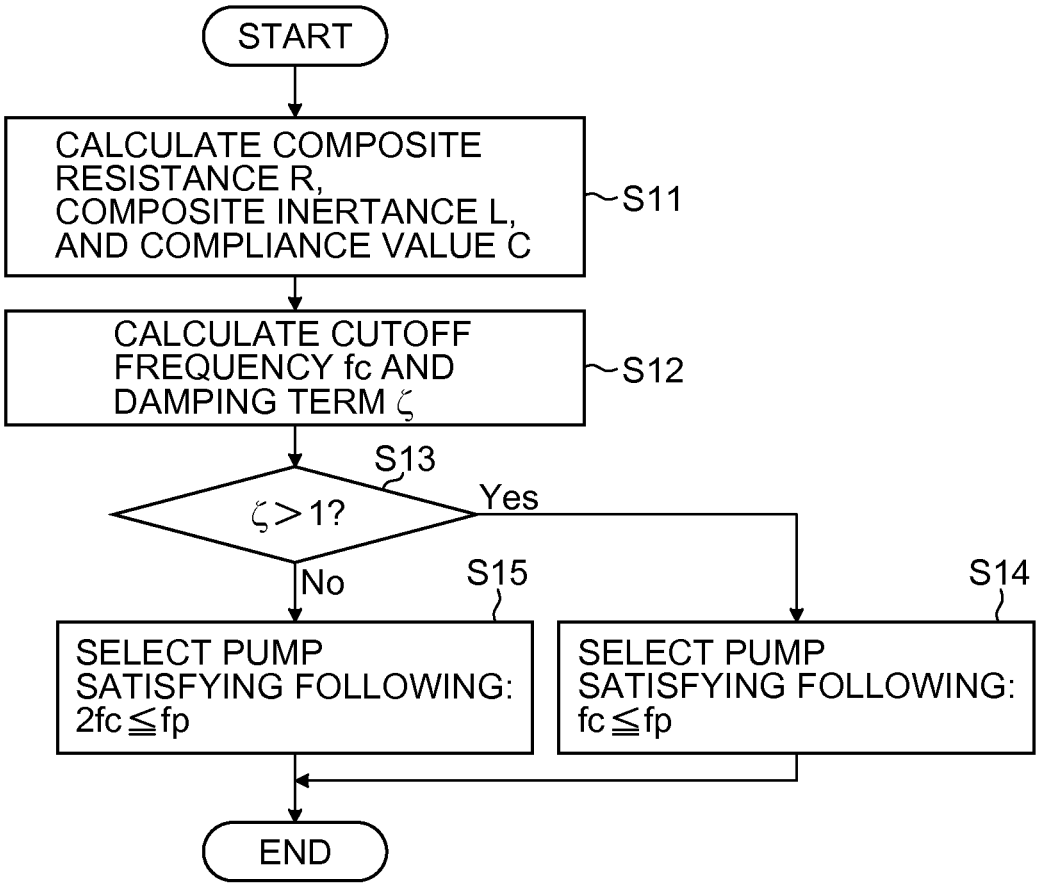
FIG. 10 is a flow chart illustrating processing of designing an optimum frequency of a pump.

With reference to the flow chart illustrated in FIG. 10, a design assistance method in accordance with the present embodiment will be described. In the present embodiment, an optimum frequency of a pump is designed in accordance with an ink supply flow channel. The design assistance device in accordance with the present embodiment is equivalent to the design assistance device 100 illustrated in FIGS. 7 and 8.

(Step S11)

Based on flow channel parameters in the print head and the ink supply flow channel whose designs are determined, the composite resistance R, the composite inertance L, and the compliance value C, are calculated. The values above may be calculated by using the expressions 9 to 11 described above.

(Step S12) From the values of L, R, and C calculated in the step S11, the cutoff frequency $f_c$ and the damping term $\zeta$ of the supply system of the ink is calculated by using the expressions 5 and 6 described above.

(Step S13)

Next, it is determined whether the damping term $\zeta$ calculated in the step S12 satisfies the relationship as follows: $\zeta > 1$. If the relationship is satisfied, the processing proceeds to a step S14, and if the relationship is not satisfied, the processing proceeds to a step S15.

(Step S14)

If $\zeta > 1$ is satisfied, there is performed a display showing that a pump satisfying the relationship as follows: $f_c \leq f_p$, should be selected, and then the processing is ended. The user finds the display and can recognize an appropriate pulsation frequency of a pump. In addition, a specific frequency of a pump, satisfying the relationship as follows: $f_c \leq f_p$, may be displayed.

(Step S15)

If $\zeta \leq 1$ is satisfied, a display showing that a pump satisfying the relationship as follows: $2f_c \leq f_p$, should be selected to prevent resonance, and then the processing is ended. The user finds the display and can recognize an appropriate pulsation frequency of a pump. In addition, a specific frequency of a pump, satisfying the relationship as follows: $2f_c \leq f_p$, may be displayed.

Although the liquid ejection device 10 for feeding ink to the non-circulation type print head illustrated in FIG. 1 is also described in the present embodiment, the present embodiment is also applicable to a liquid supply device provided with a supply-side pump and a recovery-side pump, such as the liquid ejection device 40 illustrated in FIG. 4. In this case, it is possible to optimize the supply-side pump and the recovery-side pump by applying the processing illustrated in FIG. 10 to each of the ink channels thereof by using the equivalent circuit illustrated in FIG. 6.

The liquid ejection device is designed (an example of a design step) based on flow channel parameters designed by the design assistance method of the present embodiment, and the designed liquid ejection device is manufactured (an example of a manufacturing method of a liquid ejection device), so that it is possible to acquire a liquid ejection device in which pulsation of the pump is reduced and resonance does not occur.

Example 1

Next, there will be described a case of applying a pump suitable for a system of a print head and an ink supply channel by using a specific numeric value.

In a case where a composite resistance and an inertance of a print head and an ink supply system are equivalent to those of a tube with an inner diameter of 4 mm, and a length of 1 m, the composite resistance and the inertance are expressed as follows: $R = 9.07 \times 10^8$ (Pa·s/m$^3$), and $L = 7.96 \times 10^7$ (kg/m$^4$).

In addition, in a case where air of 100 cc is used in a damper at this time, a compliance value is expressed as follows: $C = 7.14 \times 10^{-10}$ (m$^3$/Pa), where volume $V = 1.00 \times 10^{-4}$ (m$^3$), and an elastic modulus $\kappa = 1.40 \times 10^5$ (Pa).

From the values above, a cutoff frequency becomes 0.68 (Hz), and a damping term $\zeta$ becomes 1.36. Thus, a pump with a pulsation frequency higher than 0.68 (Hz) may be used.

Example 2

In a case where a composite resistance and an inertance of a print head and an ink supply system are equivalent to those of a tube with an inner diameter of 6 mm, and a length of 1 m, the composite resistance and the inertance are expressed as follows: $R=1.79\times10^{8}$ (Pa·s/m$^3$), and $L=3.54\times10^{7}$ (kg/m$^4$). In addition, in a case where air of 100 cc is used in a damper at this time, a compliance value is expressed as follows: $C=7.14\times10^{-10}$ (m$^3$/Pa).

From the values above, a cutoff frequency becomes 1.00 (Hz), and a damping term $\zeta$ becomes 0.40. Thus, a pump with a pulsation frequency higher than $1.00\times2=2.00$ (Hz) may be used.

In a case where a pump with a pulsation frequency equal to or less than 2 Hz is to be used, a filter and the like are provided in the flow channel to increase R (by $2.66\times10^{8}$ (Pa·s/m$^3$)), so that the damping term $\zeta$ becomes 1, thereby making it possible to use a pump with a pulsation frequency of 1 (Hz).

In a case where a pump with a pulsation frequency lower than the above is to be used, flow channel parameters may be changed to change values of inertance (C and L) to cope with the case.

Application Example

Next, there will be described an ink jet recording device to which the liquid ejection device 10 or 40 is applied, as an application for the liquid ejection device described above.

(Entire Configuration of an Ink Jet Recording Device)

Figure 11:
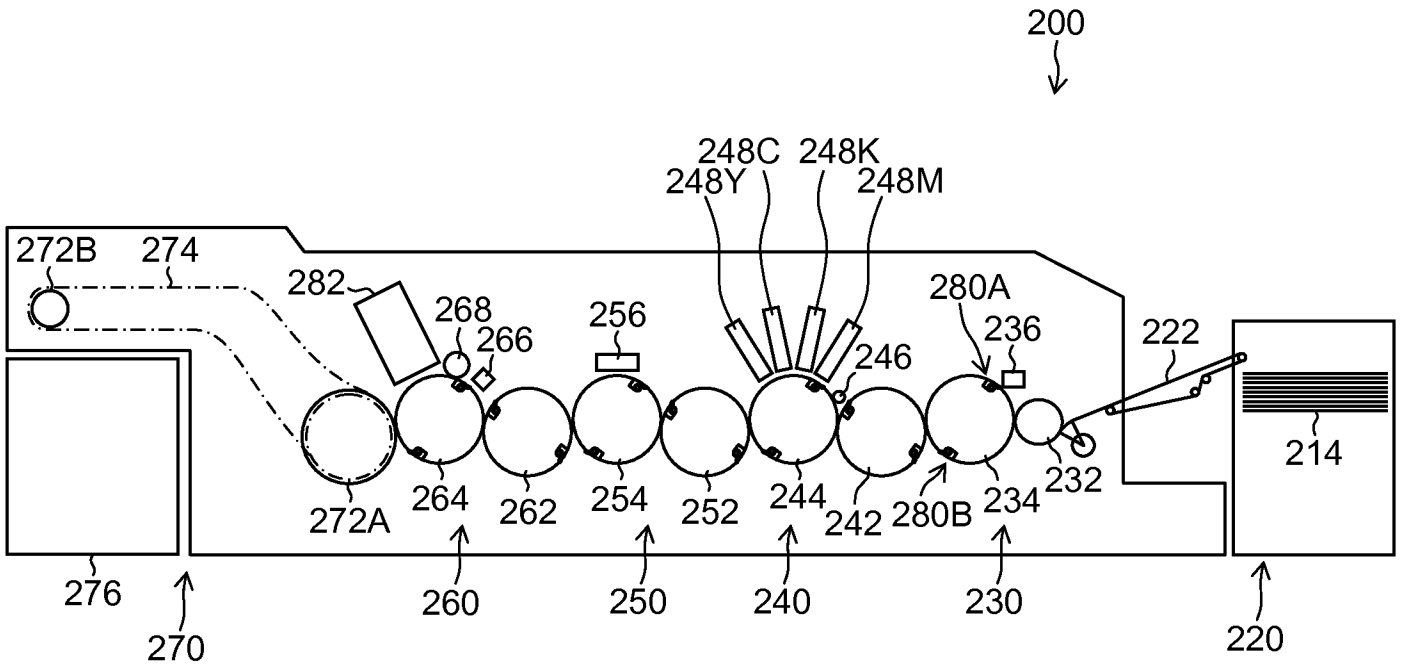
FIG. 11 is a configuration diagram illustrating an entire configuration of an ink jet recording device.

FIG. 11 is a configuration diagram illustrating an entire configuration of an ink jet recording device including a liquid ejection device in accordance with the present embodiment. The figure illustrates an ink jet recording device 200 that is a recording device of a two-liquid coagulation method in which ink including a color material and coagulating treatment liquid with a function of coagulating the ink are used to form an image on a recording surface of a recording medium 214 based on predetermined image data.

The ink jet recording device 200 includes a paper feeding unit 220, a treatment liquid applying unit 230, a drawing unit 240, a dry processing unit 250, a fixing processing unit 260, and an ejection unit 270. In addition, the drawing unit 240 is provided with a liquid ejection device that is not illustrated in FIG. 11.

In pre-stages of the treatment liquid applying unit 230, the drawing unit 240, the dry processing unit 250, and the fixing processing unit 260, feeding barrels 232, 242, 252, and 262 are provided, respectively, as means for delivering the recording medium 214 to be fed, as well as in the treatment liquid applying unit 230, the drawing unit 240, the dry processing unit 250, and the fixing processing unit 260, drum-shaped pressing barrels 234, 244, 254, and 264 are provided, respectively, as means for feeding the recording medium 214 while holding the medium.

Each of the feeding barrels 232 to 262 and the pressing barrels 234 to 264 is provided with grippers 280A and 280B that pinch and hold a front end of the recording medium 214, the grippers being provided at a predetermined position in an outer peripheral surface of each of the barrels. The grippers 280A and 280B have the same structure of pinching and holding the front end of the recording medium 214, and have the same structure of delivering the recording medium 214 to the gripper provided in another pressing barrel or feeding barrel. In addition, the grippers 280A and 280B are arranged at symmetric positions 180° apart in a rotation direction of the pressing barrel 234 in the outer peripheral surface of the pressing barrel 234.

When the feeding barrels 232 to 262 and the pressing barrels 234 to 264 are rotated in a predetermined direction while the front end of the recording medium 214 is pinched by the grippers 280A and 280B, the recording medium 214 is rotated and fed around the outer peripheral surfaces of the feeding barrels 232 to 262 and the pressing barrels 234 to 264.

In FIG. 11, reference numerals are applied to only the grippers 280A and 280B provided in the pressing barrel 234, and reference numerals for grippers provided in other pressing barrels and feeding barrels are omitted.

When the recording medium (sheet paper) 214 stored in the paper feeding unit 220 is fed to the treatment liquid applying unit 230, coagulating treatment liquid (hereinafter, sometimes simply referred as "treatment liquid") is applied to a recording surface of the recording medium 214 held on the outer peripheral surface of the pressing barrel 234. The "recording surface of the recording medium 214" is an outer surface in a state where the recording medium is held by the pressing barrels 234 to 264, and is opposite to a surface held by the pressing barrels 234 to 264.

Then, the recording medium 214 to which the coagulating treatment liquid is applied is fed to the drawing unit 240, and the drawing unit 240 applies color ink to an area where the coagulating treatment liquid is applied on the recording surface, so that a desired image is formed.

In addition, the recording medium 214 on which an image is formed by using the color ink is fed to the dry processing unit 250, and the dry processing unit 250 applies dry processing to the recording medium, and after the dry processing, the recording medium is fed to the fixing processing unit 260, then fixing processing is applied to the recording medium. The dry processing and the fixing processing are applied to allow the image formed on the recording medium 214 to be solid. As above, a desired image is formed on the recording surface of the recording medium 214, and after the image is fixed on the recording surface of the recording medium 214, the recording medium 214 is fed to the outside of the ink jet recording device from the ejection unit 270.

Hereinafter, each of the units of the ink jet recording device 200 (the paper feeding unit 220, the treatment liquid applying unit 230, the drawing unit 240, the dry processing unit 250, the fixing processing unit 260, and the ejection unit 270) will be described in detail.

(Paper Feeding Unit)

The paper feeding unit 220 is provided with a paper feed tray 222, and a feeding mechanism (not illustrated), and is configured to feed the recording medium 214 one by one from the paper feed tray 222. The recording medium 214 fed from the paper feed tray 222 is positioned by a guide member (not illustrated) so that a front end of the recording medium is positioned at a position of each of the grippers (not illustrated) of the feeding barrel (paper feed barrel) 232, and is then temporarily stopped. Then, the grippers (not illustrated) pinch and hold the front end of the recording medium 214 to deliver the recording medium 214 to the grippers provided in a treatment liquid barrel 234.

(Treatment Liquid Applying Unit)

The treatment liquid applying unit 230 includes the treatment liquid barrel (treatment liquid drum) 234 that holds the recording medium 214 delivered from the paper feed barrel 232 on an outer peripheral surface thereof to feed the recording medium 214 in a predetermined feeding direction, and a treatment liquid coating device 236 that applies treatment liquid to a recording surface of the recording medium 214 held on the outer peripheral surface of the treatment liquid barrel 234. When the treatment liquid barrel 234 is rotated in a counterclockwise direction in FIG. 11, the recording medium 214 is rotated and fed around the outer peripheral surface of the treatment liquid barrel 234 in the counterclockwise direction.

The treatment liquid coating device 236 illustrated in FIG. 11 is provided at a position facing to the outer peripheral surface (recording medium holding surface) of the treatment liquid barrel 234. An aspect of the treatment liquid coating device 236 includes one including a treatment liquid container that stores the treatment liquid, a scoop roller whose part is immersed in the treatment liquid in the treatment liquid container, the scoop roller scooping up the treatment liquid in the treatment liquid container, and a coating roller (rubber roller) that moves the treatment liquid scooped up by the scoop roller on the recording medium 214, for example.

An aspect is preferable to include a coating roller movement mechanism for moving the coating roller in a vertical direction (a normal direction of the outer peripheral surface of the treatment liquid barrel 234) to prevent the treatment liquid from being applied to a portion other than the recording medium 214. In addition, the grippers 280A and 280B that holds the front end of the recording medium 214 is arranged so as not to project from a peripheral surface.

The treatment liquid applied to the recording medium 214 by the treatment liquid coating device 236 includes a color material flocculating agent for flocculating a color material (pigment) in ink applied by the drawing unit 240. When the treatment liquid and the ink are brought into contact with each other on the recording medium 214, separation of the color material and a solvent in the ink is promoted.

It is preferable that the treatment liquid coating device 236 applies the treatment liquid to the recording medium 214 while measuring the amount of the treatment liquid, and preferable to reduce a film thickness of the treatment liquid on the recording medium 214 so that the film thickness is sufficiently smaller than a diameter of an ink droplet ejected from the drawing unit 240.

(Drawing Unit)

The drawing unit 240 includes a drawing barrel (drawing drum) 244 that holds and feeds the recording medium 214, a paper sheet pressing roller 246 that allows the recording medium 214 to be brought into close contact with the drawing barrel 244, ink jet heads 248M, 248K, 248C, and 248Y that apply ink to the recording medium 214. The drawing barrel 244 has a basic structure common to that of the treatment liquid barrel 234 described before.

The paper sheet pressing roller 246 is a guide member for allowing the recording medium 214 to be brought into close contact with an outer peripheral surface of drawing barrel 244. The paper sheet pressing roller 246 is arranged so as to face to the outer peripheral surface of the drawing barrel 244, and arranged on a downstream side in a feeding direction of the recording medium 214 from a delivery position of recording medium 214, between the feeding barrel 242 and the drawing barrel 244, as well as on an upstream side in the feeding direction of the recording medium 214 from the ink jet heads 248M, 248K, 248C, and 248Y.

In addition, there is arranged a floated paper sheet detection sensor (not illustrated) in a space between the paper sheet pressing roller 246 and the ink jet head 248M provided on a most upstream side in the feeding direction of the recording medium 214. The floated paper sheet detection sensor detects the amount of float of the recording medium 214 immediately before the recording medium 214 enters immediately below the ink jet heads 248M, 248K, 248C, and 248Y. The ink jet recording device 200 illustrated in the present example is configured such that, if the amount of float of the recording medium 214 detected by the floated paper sheet detection sensor exceeds a predetermined threshold value, the fact is notified, as well as feeding of the recording medium 214 is stopped.

The recording medium 214 delivered to the drawing barrel 244 from the feeding barrel 242 is pressed by the paper sheet pressing roller 246 to be brought into close contact with the outer peripheral surface of the drawing barrel 244 when rotated in a state where a front end of the recording medium is held by the grippers (reference numerals are omitted). In this way, after the recording medium 214 is brought into close contact with the outer peripheral surface of the drawing barrel 244, the recording medium 214 is fed to a printing area immediately below the ink jet heads 248M, 248K, 248C, and 248Y in a state of no float of the recording medium from the outer peripheral surface of the drawing barrel 244.

The ink jet heads 248M, 248K, 248C, and 248Y correspond to inks of 4 colors of magenta (M), black (K), cyan (C), and yellow (Y), respectively. The ink jet heads are arranged in order from an upstream side in a rotation direction (a counterclockwise direction in FIG. 11) of the drawing barrel 244, as well as arranged so that an ink ejection face (nozzle face) of each of the ink jet heads 248M, 248K, 248C, and 248Y faces to the recording surface of the recording medium 214 held by the drawing barrel 244. The "ink ejection face (nozzle face)" is a face of each of the ink jet heads 248M, 248K, 248C, and 248Y, facing to the recording surface of the recording medium 214, and is a face in which a nozzle that ejects the ink described later (illustrated in FIG. 13 by applying reference numeral 308) is formed.

In addition, the ink jet heads 248M, 248K, 248C, and 248Y illustrated in FIG. 11 are arranged at an angle with respect to a horizontal plane so that the recording surface of the recording medium 214 held on the outer peripheral surface of the drawing barrel 244 and the nozzle faces of the ink jet heads 248M, 248K, 248C, and 248Y are nearly parallel to each other.

The ink jet heads 248M, 248K, 248C, and 248Y are a head of a full line type with a length corresponding to a maximum width (a length in a direction orthogonal to the feeding direction of the recording medium 214) of an image formation area in the recording medium 214, and are fixed so as to extend in the direction orthogonal to the feeding direction of the recording medium 214. In addition, each of the ink jet heads 248M, 248K, 248C, and 248Y receives ink from an ink supply device described in detail later.

The nozzle face (liquid ejection face) of each of the ink jet heads 248M, 248K, 248C, and 248Y includes nozzles for ejecting ink that are arranged across an overall width of the image formation area of the recording medium 214 in a matrix.

When the recording medium 214 is fed to the printing area immediately below the ink jet heads the ink jet heads 248M, 248K, 248C, and 248Y, the ink jet heads 248M, 248K, 248C, and 248Y eject inks of respective colors to an area in the recording medium 214 to which the coagulating treatment liquid is applied based on image data.

When each of the ink jet heads 248M, 248K, 248C, and 248Y ejects a droplet of a corresponding color ink to the recording surface of the recording medium 214 held on the outer peripheral surface of the drawing barrel 244, the treatment liquid and the ink are brought into contact with each other on the recording medium 214 to allow an agglutination reaction of a color material (pigment-based color material) dispersed in the ink or a color material (dye-based color material) insolubilized in the ink to occur to form a color material aggregate. Accordingly, transfer of the color material in the image formed on the recording medium 214 (dot displacement, and irregular color of a dot) is prevented.

In addition, since the drawing barrel 244 of the drawing unit 240 is structurally separated from the treatment liquid barrel 234 of the treatment liquid applying unit 230, the treatment liquid does not adhere to the ink jet heads 248M, 248K, 248C, and 248Y, so that it is possible to reduce a cause of abnormal ejection of ink.

In the present example, although an example of a configuration of standard colors (4 colors) of MKCY is illustrated, a combination of ink colors and the number of colors is not limited to that of the present embodiment, so that a light ink, a dark ink, and a special color ink may be added if necessary. For example, it is also possible to make a configuration of adding an ink jet head for ejecting light-color ink such as light cyan and light magenta, and arrangement order of heads of respective colors is not particularly limited.

(Dry Processing Unit)

The dry processing unit 250 includes a dry barrel (dry drum) 254 that holds and feeds the recording medium 214 after image formation, and a dry processing device 256 that performs dry processing of evaporating moisture (liquid component) on the recording medium 214. Since the dry barrel 254 has a basic structure common to that of each of the treatment liquid barrel 234 and the drawing barrel 244 described before, hereinafter a description of the dry barrel 254 is omitted.

The dry processing device 256 is arranged at a position facing to an outer peripheral surface of the dry barrel 254, and evaporates moisture existing on the recording medium 214. When the drawing unit 240 applies ink to the recording medium 214, a liquid component (solvent component) of the ink and a liquid component (solvent component) of the treatment liquid remain on the recording medium 214 due to an agglutination reaction of treatment liquid and ink. Thus, it is necessary to remove the liquid components.

The dry processing device 256 performs dry processing of evaporating a liquid component existing on the recording medium 214 by using heating by a heater or blowing air by a fan, or a combination thereof to remove the liquid component on the recording medium 214. The heating amount and/or volume of air blown applied to the recording medium 214 is appropriately determined depending on parameters such as the amount of moisture remaining on the recording medium 214, a type of the recording medium 214, and a feeding speed of the recording medium 214 (dry processing time).

When the dry processing device 256 performs the dry processing, it is possible to reduce causes of abnormal ejection of ink due to drying of a head meniscus portion caused by heat or blown air in the ink jet heads 248M, 248K, 248C, and 248Y because the dry barrel 254 of the dry processing unit 250 is structurally separated from the drawing barrel 244 of the drawing unit 240.

In order to achieve an effect of correcting cockling of the recording medium 214, it is preferable that a curvature of the dry barrel 254 is 0.002 (1/mm) or more. In addition, in order to prevent curvature (curl) of the recording medium after the dry processing, it is preferable that the curvature of the dry barrel 254 is 0.0033 (1/mm) or less.

In addition, it is preferable to provide means (such as a built-in heater) for adjusting surface temperature of the dry barrel 254, and to adjust the surface temperature at 50° C. or more. Heat treatment is performed from a back surface of the recording medium 214 to promote dry. As a result, image destruction in fixing processing of the next stage is prevented. In the aspect above, it is more effective to provide means for allowing the recording medium 214 to be brought into close contact with the outer peripheral surface of the dry barrel 254. The means for allowing the recording medium 214 to be brought into close contact therewith includes vacuum absorption, electrostatic adsorption, and the like, for example.

Although an upper limit of the surface temperature of the dry barrel 254 is not particularly limited, it is preferable to set the upper limit at 75° C. or less (more preferably at 60° C. or less) from a viewpoint of safety (prevention of burn injury caused by high temperature) of a maintenance operation such as cleaning of ink adhering to the surface of the dry barrel 254.

The recording medium 214 is held on the outer peripheral surface of the dry barrel 254 so that the recording surface thereof faces to the outside (that is, in a state where the recording surface of the recording medium 214 is curved so as to project), and the dry processing is applied to the recording medium 214 while the recording medium 214 is rotated and fed. As a result, uneven dry caused by a wrinkle and a float of the recording medium 214 is prevented.

(Fixing Processing Unit)

The fixing processing unit 260 includes a fixing barrel (fixing drum) 264 that holds and feeds the recording medium 214, a heater 266 that applies heat treatment to the recording medium 214 on which an image is formed as well as liquid is removed, and a fixing roller 268 that presses the recording medium 214 from the recording surface side thereof. Since the fixing barrel 264 has a basic structure common to that of each of the treatment liquid barrel 234, the drawing barrel 244, and the dry barrel 254, a description of the fixing barrel 264 is omitted. Each of the heater 266 and the fixing roller 268 is arranged at a position facing to an outer peripheral surface of the fixing barrel 264, and is arranged in order from an upstream side in a rotation direction (in a counterclockwise direction in FIG. 11) of the fixing barrel 264.

In the fixing processing unit 260, the heater 266 applies preheating treatment to the recording surface of the recording medium 214, and the fixing roller 268 applies fixing processing to the recording surface of the recording medium 214. Heating temperature of the heater 266 is appropriately determined depending on a type of the recording medium, a type of ink (a type of polymer fine particles included in the ink), and the like. There is thought an aspect in which the heating temperature is set at glass transition point temperature or minimum film formation temperature of the polymer fine particles included in the ink, for example.

The fixing roller 268 melts and sticks self-dispersing polymer fine particles in the ink by heating and pressing the dried ink so that the ink is coated, and is configured to heat and press the recording medium 214. Specifically, the fixing roller 268 is arranged to be pressed to the fixing barrel 264 and to be contact therewith, and a nip roller is provided between the fixing roller 268 and the fixing barrel 264. Accordingly, the recording medium 214 is nipped between the fixing roller 268 and the fixing barrel 264 to be nipped at a predetermined nip pressure, and then the fixing processing is applied to the recording medium 214.

The configuration of the fixing roller 268 includes an aspect of providing a heating roller including a halogen lamp inserted into a metal pipe made of aluminum with good thermal conductivity, and the like, for example. The heating roller described above heats the recording medium 214, and when thermal energy more than that at the glass transition point temperature of the polymer fine particles included in the ink is applied to the recording medium 214, the polymer fine particles are melted to form a transparent film on a surface of an image.

Under the state above, when the recording surface of the recording medium 214 is pressed, melted polymer fine particles are squeezed into asperities on the recording medium 214 to be fixed. As a result, the asperities on a surface of an image are leveled, so that preferable glossiness of the image can be obtained. It is also preferable that the fixing rollers 268 are provided at a plurality of stages in accordance with a thickness of an image layer and a glass transition point temperature property of polymer fine particles.

In addition, it is preferable that surface hardness of the fixing roller 268 is 71° or less. If a surface of the fixing roller 268 is more softened, there is expected an effect of following asperities of the recording medium 214, caused by cockling. As a result, uneven fixing caused by the asperities of the recording medium 214 is effectively prevented.

The ink jet recording device 200 illustrated in FIG. 11 includes an in-line sensor 282 provided at a subsequent stage (downstream side of a feeding direction of the recording medium) of a processing area of the fixing processing unit 260. The in-line sensor 282 reads an image (or a checking pattern formed in a margin area of the recording medium 214) formed on the recording medium 214, and a charge coupled device (CCD) line sensor is suitably used for the in-line sensor.

The ink jet recording device 200 illustrated in the present example determines whether there is abnormal ejection of the ink jet heads 248M, 248K, 248C, and 248Y based on a reading result of the in-line sensor 282. In addition, an aspect in which the in-line sensor 282 includes measuring means for measuring the amount of moisture, surface temperature, glossiness, and the like, can be adopted. In the aspect described above, parameters such as processing temperature of the dry processing unit 250, and heating temperature and pressing pressure of the fixing processing unit 260, are appropriately adjusted based on reading results of the amount of moisture, the surface temperature, and the glossiness, as well as the control parameters described above are appropriately adjusted in accordance with temperature change in the ink jet recording device and temperature change in each of the units.

(Ejection Unit)

As illustrated in FIG. 11, the ejection unit 270 is provided, followed by the fixing processing unit 260. The ejection unit 270 includes an endless feeding chain 274 stretched between stretching rollers 272A and 272B, and an ejection tray 276 that stores the recording medium 214 after image formation.

The recording medium 214 after the fixing processing fed from the fixing processing unit 260 is fed by the transportation chain 274 to be ejected to the ejection tray 276.

(Structure of Ink Jet Heads)

Next, an example of structures of the ink jet heads 248M, 248K, 248C, and 248Y, provided in the drawing unit 240, will be described. Since the structures of the ink jet heads 248M, 248K, 248C, and 248Y, corresponding to respective colors, are common to each other, hereinafter each of the ink jet heads (hereinafter, sometimes simply "head") is designated by reference numeral 300 as a representative of the ink jet heads.

Figure 12:
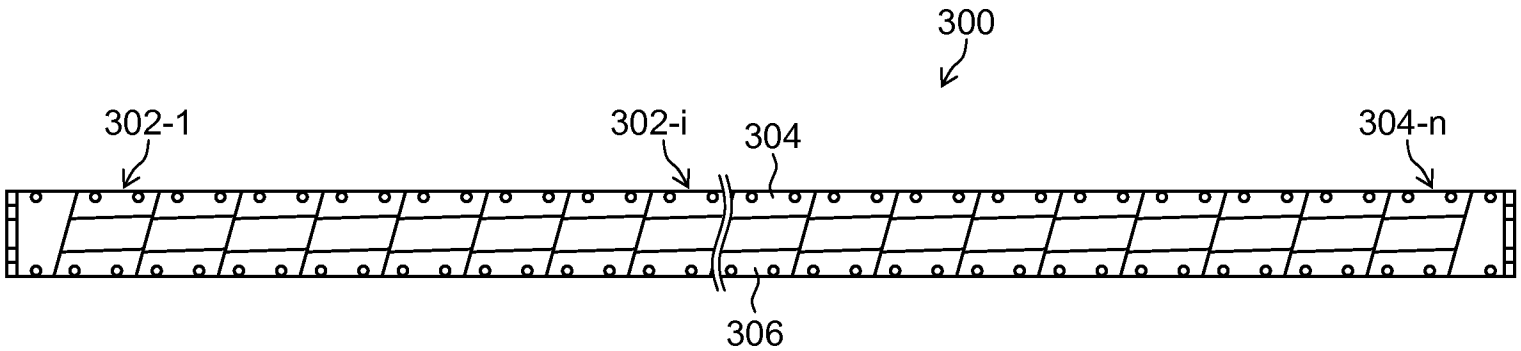
FIG. 12 is a schematic configuration view of an ink jet head.

FIG. 12 is a schematic configuration view of an ink jet head 300, and illustrates a recording surface of a recording medium viewed from the ink jet head 300 (a plane perspective view of the head). The head 300 illustrated in FIG. 12 is composed of n pieces of head modules 302-*i* (i is an integer between 1 and n) that are joined in a line along a longitudinal direction of the head 300 to form a multi-head. In addition, each of the head modules 302-*i* is supported by covers 304 and 306 from both sides of the head 300 in a lateral direction head. It is also possible to form the multi-head by arranging the head modules 302 in a staggered shape.

Application examples of a multi-head composed of a plurality of sub-heads include a full line type head corresponding to an overall width of a recording medium. The full line type head has a structure in which a plurality of nozzles (illustrated in FIG. 13 by being designated by reference numeral 308) are arranged in a direction (main scanning direction) orthogonal to a movement direction (sub-scanning direction) of a recording medium by corresponding to a length (width) of the recording medium in the main scanning direction. Accordingly, it is possible to form an image over the whole area of the recording medium by a so-called single pass image recording method in which the head 300 having the structure above relatively scans the recording medium only once.

Each of the head modules 302-*i* constituting the head 300 has a planar shape of a substantially parallelogram, and is provided with an overlap portion between sub heads adjacent to each other. The overlap portion joins the sub heads to each other, and are formed by nozzles adjacent to each other with different dots, the nozzles belonging to the respective sub heads, in an arrangement direction of the head modules 302-*i*.

Figure 13:
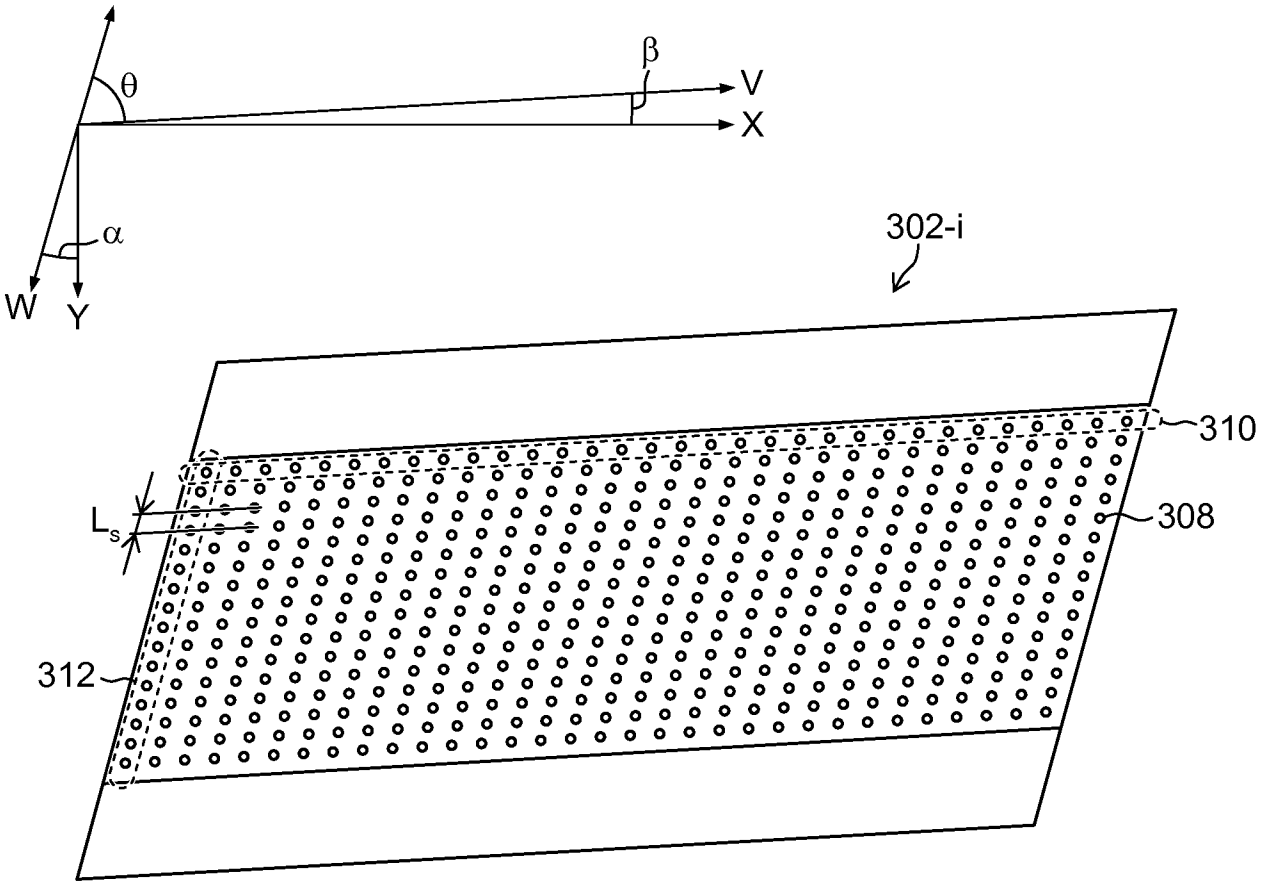
FIG. 13 is a plan view illustrating nozzle arrangement of a head module.

FIG. 13 is a plan view illustrating nozzle arrangement of the head module 302-*i*. As illustrated in the figure, each of the head modules 302-*i* has a structure in which nozzles 308 are two-dimensionally arranged. The head provided with the head modules 302-*i* above is a so-called matrix head. The head module 302-*i* illustrated in FIG. 13 has a structure in which a large number of nozzles 308 are arranged along a column direction W inclined at an angle $\alpha$ with respect to a sub-scanning direction Y and a row direction V inclined at an angle $\beta$ with respect to a main scanning direction X, and substantial arrangement density of the nozzles in the main scanning direction X is increased. In FIG. 13, a nozzle group (nozzle row) arranged along the row direction V is designated by reference numeral 310, a nozzle group (nozzle column) arranged along the column direction W is designated by reference numeral 312.

Another example of a matrix arrangement of the nozzles 308 includes a configuration in which the plurality of nozzles 308 is arranged along a row direction along the main scanning direction X and a column direction inclined with respect to the main scanning direction X.

Figure 14:
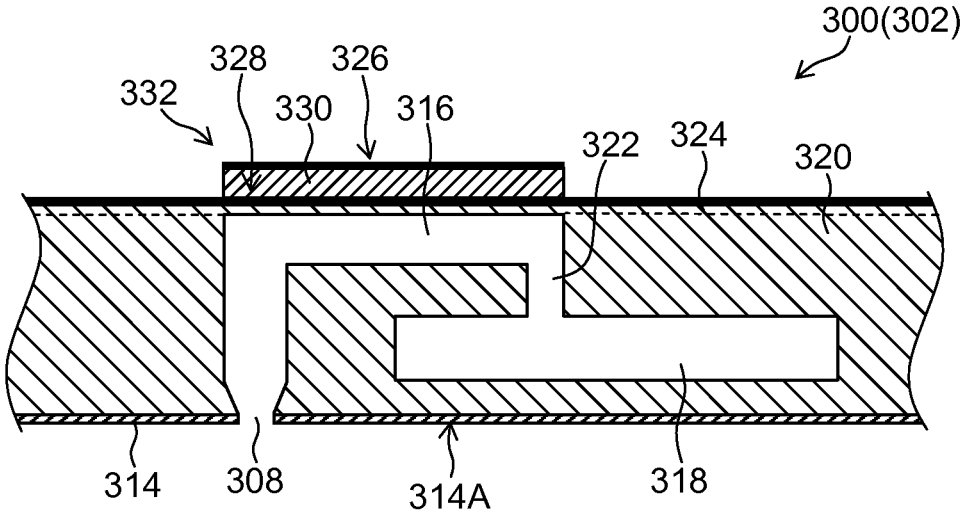
FIG. 14 is a sectional view illustrating a three-dimensional configuration of a droplet ejection element.

FIG. 14 is a sectional view illustrating a three-dimensional configuration of a droplet ejection element (an ink chamber unit corresponding to one nozzle 308) for one channel, to be a recording element unit. As illustrated in the figure, the head 300 (head module 302) of the present example has a structure in which a nozzle plate 314 provided with nozzles 308, a flow channel plate 320 provided with flow channels such as a pressure chamber 316, a common flow channel 318, and the like, are laminated and bonded to each other. The nozzle plate 314 constitutes a nozzle face 314A of the head 300, and provided with a plurality of two-dimensional nozzles 308 that communicate with respective pressure chambers 316.

The flow channel plate 320 is a flow channel forming member that constitutes a sidewall portion of the pressure chamber 316, as well as that is provided with a supply port 322 serving as a throttle (most narrowed portion) of an individual supply channel through which ink is guided from the common flow channel 318 to the pressure chamber 316. In FIG. 14, although the structure is simply shown for convenience of explanation, the flow channel plate 320 has a structure in which one or more substrates are laminated.

It is possible to form the nozzle plate 314 and the flow channel plate 320 into required shapes by using silicon as a material in a semiconductor manufacturing process.

The common flow channel 318 communicates with an ink tank (not illustrated) serving as an ink supply source, and ink supplied from the ink tank is supplied to each of the pressure chambers 316 through the common flow channel 318.

The pressure chamber 316 includes a part of faces (a top face in FIG. 14) composed of a vibrating plate 324 on which there is bonded a piezo actuator 332 composed of an individual electrode 326, a bottom electrode 328, and a piezoelectric body 330 sandwiched between the individual electrode 326 and the bottom electrode 328. If the vibrating plate 324 is composed of a metal thin film or a metal oxide film, the vibrating plate 324 serves as a common electrode corresponding to the bottom electrode 328 of the piezo actuator 332. In an aspect in which a vibrating plate is formed of non-conductive material such as resin, a bottom electrode layer formed of conductive material such as metal is formed on a surface of a member of the vibrating plate.

When drive voltage is applied to the individual electrode 326, the piezo actuator 332 deforms to change the volume of the pressure chamber 316. Accordingly, pressure in the pressure chamber 316 is changed to eject ink from the nozzle 308. When the piezo actuator 332 returns to an original state after the ink is ejected, new ink is supplied from the common flow channel 318 through the supply port 322 so that the pressure chamber 316 is refilled with the new ink.

As illustrated in FIG. 13, a large number of the ink chamber units having the structure above are arranged along the column direction W inclined at the angle $\alpha$ with respect to the sub-scanning direction Y and the row direction V inclined at the angle $\beta$ with respect to the main scanning direction X, with a predetermined arrangement pattern, to form a lattice shape. As a result, a dense nozzle head of the present example is achieved. In the matrix arrangement above, in a case where a distance between nozzles adjacent to each other in the sub-scanning direction Y is indicated as Ls, it is possible to equivalently consider that the respective nozzles 308 are substantially linearly arranged in the main scanning direction X at a constant pitch $P=Ls/\tan\theta$.

In the present example, although the piezo actuator 332 is applied as ejection force generation means for ejecting ink from the nozzles 308 provided in the head 300, it is possible to apply a thermal method in which ink is ejected by using pressure generated by film boiling by heating of a heater provided in the pressure chamber 316.

(Description of a Control System)

Figure 15:
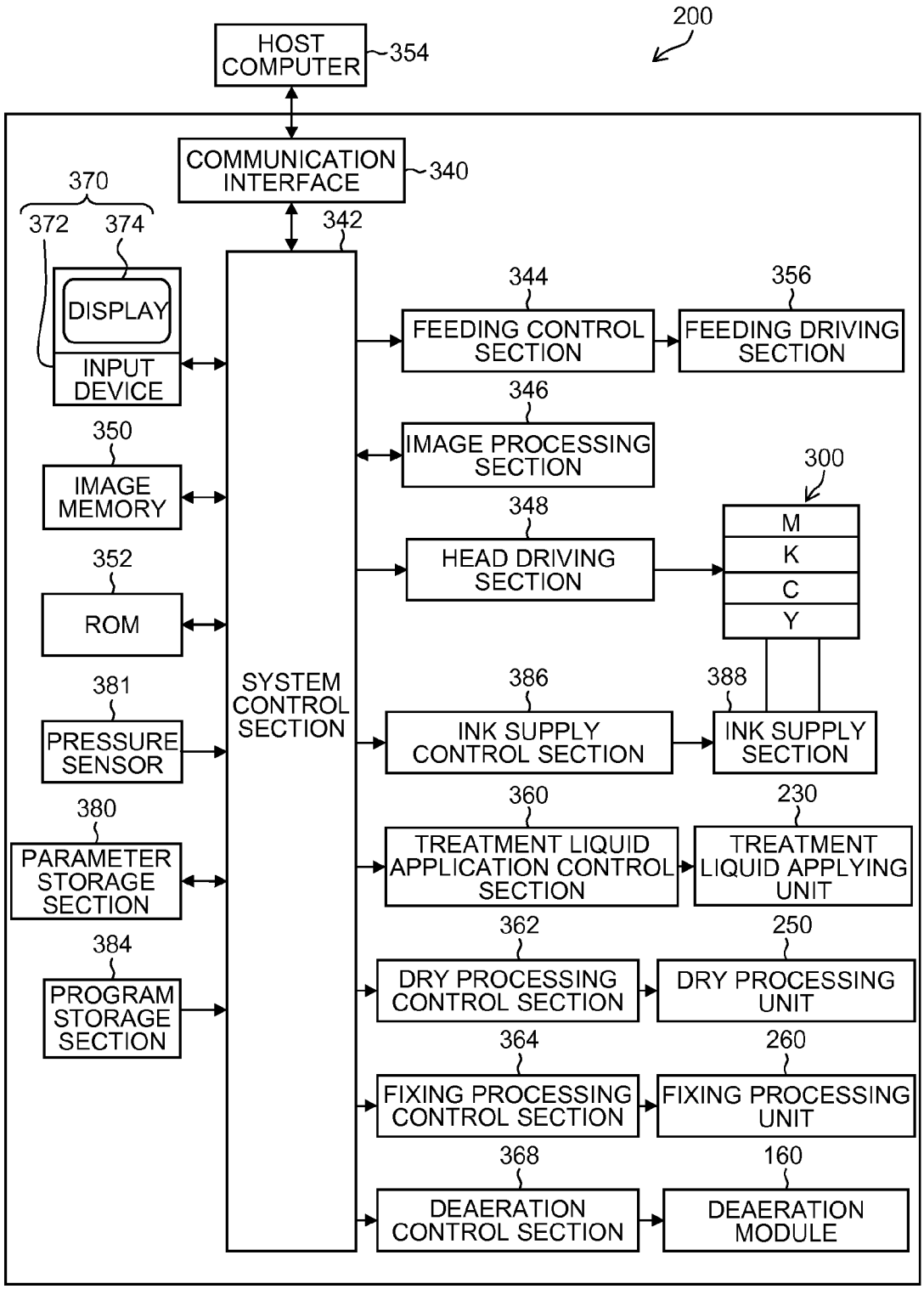
FIG. 15 is a block diagram illustrating a configuration of a control system of the ink jet recording device.

FIG. 15 is a block diagram illustrating a schematic configuration of a control system of the ink jet recording device 200. The ink jet recording device 200 includes a communication interface 340, a system control section 342, a feeding control section 344, an image processing section 346, and a head driving section 348, as well as an image memory 350, and a read only memory (ROM) 352.

The communication interface 340 serves as an interface section that receives image data transmitted from a host computer 354. For the communication interface 340, a serial interface such as a universal serial bus (USB) and a parallel interface such as a Centronics may be applicable. In addition, the communication interface 340 may include a buffer memory (not illustrated) to increase a communication speed.

The system control section 342 includes a central processing unit (CPU), a periphery circuit of the CPU, and the like. In addition, the system control section 342 serves as a control device for controlling the entire ink jet recording device 200 in accordance with a predetermined program, as well as serves as an arithmetic unit for performing various calculations, and further serves as a memory controller of the image memory 350 and the ROM 352. That is, the system control section 342 controls each of the units such as the communication interface 340 and the feeding control section 344, and controls communication with the host computer 354 and reading and writing of the image memory 350 and the ROM 352, as well as creates a control signal for controlling each of the units described above.

The host computer 354 transmits image data to the ink jet recording device 200 through the communication interface 340, and then the image processing section 346 applies predetermined image processing to the image data.

The image processing section 346 serves as a control section that has a signal (image) processing function of performing processing, such as various types of processing and correction, for creating a signal for print control from the image data, and that supplies created print data to the head driving section 348. In addition, the image processing section 346 applies required signal processing to the image data, and controls the amount of ejection of droplets (deposition amount) and ejection timing of the head 300 based on the image data through the head driving section 348. Accordingly, a desired dot size and arrangement of dots are achieved. The head driving section 348 illustrated in FIG. 15 may include a feedback control system for keeping driving conditions of the head 300 constant.

The feeding control section 344 controls feeding timing and feeding speed of the recording medium 214 (refer to FIG. 11) based on the signal for print control created by the image processing section 346. FIG. 15 illustrates a feeding driving section 356 that includes a motor for rotating the pressing barrels 234 to 264, a motor for rotating the feeding barrels 232 to 262, a motor of a feeding mechanism for the recording medium 214 in the paper feeding unit 220, a motor for driving the stretching roller 272A (272B) in the ejection unit 270, and the like, illustrated in FIG. 11. Thus, the feeding control section 344 serves as a controller for the motors described above.

The image memory (a primary storage memory) 350 serves as primary storage means for temporarily storing received image data through the communication interface 340, as well as serves as an expansion area of various programs stored in the ROM 352 and a calculation work area (such as a work area of the image processing section 346) of the CPU. For the image memory 350, there is used a volatile memory (random access memory (RAM)) capable of sequentially reading and writing.

The ROM 352 stores a program that a CPU of the system control section 342 executes, various data and control parameters, required to control each of the units of the ink jet recording device, and the like. In the ROM 352, data is read and written through the system control section 342. For the ROM 352, there may be used not only a memory composed of semiconductor elements but also a magnetism medium such as a hard disk. In addition, a detachable recording medium may be used by providing an external interface.

The ink jet recording device 200 further includes a treatment liquid application control section 360, a dry processing control section 362, and fixing processing control section 364. The treatment liquid application control section 360, the dry processing control section 362, and the fixing processing control section 364 control operations of the treatment liquid applying unit 230, the dry processing unit 250, and the fixing processing unit 260, respectively, in accordance with a command from the system control section 342.

The treatment liquid application control section 360 controls timing of application of treatment liquid based on print data acquired from the image processing section 346, as well as controls the amount of application of the treatment liquid. In addition, the dry processing control section 362 controls timing of dry processing in the dry processing device 256 as well as controls processing temperature, the volume of air blown, and the like. The fixing processing control section 364 controls temperature of the heater 266, as well as controls pressing force of the fixing roller 268.

The in-line sensor 282 illustrated in FIG. 11 is included in an in-line detector 466 that is a processing block including a signal processing section that applies predetermined signal processing, such as nozzle removal, amplification, and waveform shaping, to a reading signal outputted from the in-line sensor 282. The system control section 342 determines whether there is abnormal ejection of the head 300 based on a detection signal acquired by the in-line detector.

An ink supply control section 386 controls ink supply to the head 300 by an ink supply section 388. The liquid ejection devices 10 and 40 described above are applied to the head 300 and the ink supply section 388 illustrated in FIG. 15.

The ink jet recording device 200 shown in the present example is provided with a user interface 370. The user interface 370 includes an input device 372 for allowing an operator (user) to perform various inputs, and a display 374. For the input device 372, various forms, such as a keyboard, a mouse, a touch panel, a button, are applicable. An operator operates the input device 372 to be able to input a printing condition, to select an image quality mode, to input and edit attached information, and to search for information. In addition, the operator can find out various information, such as input content and search results, through a screen of the display 374. The display 374 also serves as means for displaying a warning such as an error message. Further, the display 374 illustrated in FIG. 15 is applicable to a display as notification means in the control system illustrated in FIG. 11.

A deaeration control section 368 controls operation of a deaeration module 160 that applies deaeration processing to liquid to be fed to the head 300 from the main tank (refer to FIG. 1).

A parameter storage section 380 stores various control parameters required to operate the ink jet recording device 200. The system control section 342 appropriately reads out parameters required for control, as well as updates (rewrites) the various parameters, if necessary.

A pressure sensor 381 includes a pressure detection element for measuring pressure in the ink flow channel, and convers information on measured pressure to an electric signal to provide the electric signal to the system control section 342. The system control section 342 transmits a command signal to the ink supply control section 386 so as to correct operation (rotation speed) of a pump included in the ink supply section 388 based on the information on measured pressure.

A program storage section 384 serves as storage means for storing a control program for allowing the ink jet recording device 200 to be operated.

The technical scope of the present invention is not limited to the scope described in the embodiments above. The configuration and the like in each of the embodiments can be appropriately combined between the respective embodiments within a range without departing from the spirit of the present invention.

What is claimed is:

1. A design assistance method for a liquid ejection device that satisfies a predetermined relationship and that includes a liquid ejection head provided with a nozzle configured to eject liquid; a liquid supply flow channel configured to supply the liquid to the liquid ejection head; and a liquid pressure applying unit configured to apply pressure to the liquid in the liquid supply flow channel through a pressure absorber, the design assistance method comprising:

an acquiring step of acquiring a pulsation frequency $f_p$ of the liquid pressure applying unit, a compliance capacity C of the pressure absorber, and a composite inertance L of the liquid ejection head and the liquid supply flow channel;

a determining step of determining whether a relationship between a cutoff frequency $f_c$ expressed by $f_c=1/(2\pi(LC)^{0.5})$ using the acquired C and L, and the pulsation frequency $f_p$ satisfies the predetermined relationship that satisfies $f_p \geq f_c$; and an outputting step of outputting a determination result in the determining step.

2. The design assistance method for the liquid ejection device according to claim 1, wherein the predetermined relationship is a relationship of $f_p \geq mf_c$, where m is a constant greater than 1.

3. The design assistance method for the liquid ejection device according to claim 1, wherein the acquiring step includes acquiring a composite resistance R of the liquid ejection head and the liquid supply flow channel, and the predetermined relationship is a relationship as follows: $f_c \leq f_p < mf_c$, where m is the constant greater than 1, and a damping term $\zeta$ expressed by $\zeta=0.5R(C/L)^{0.5}$ and satisfying $\zeta>1$.

4. The design assistance method for the liquid ejection device according to claim 2, wherein m is 2.

5. The design assistance method for the liquid ejection device according to claim 3, further comprising the steps of:

acquiring a primary design of a flow channel configuration of the liquid ejection device; and calculating the compliance capacity C, the composite resistance R, and the composite inertance L from the acquired primary design of the flow channel configuration, and wherein the outputting step includes providing an output for urging at least one of the compliance capacity C and the composite inertance L to be changed if it is determined in the determining step that the relationship between the cutoff frequency $f_c$ and the pulsation frequency $f_p$ indicates $f_p<f_c$, and providing an output for urging a value of the composite resistance R to be increased if it is determined in the determining step that the relationship between the cutoff frequency $f_c$ and the pulsation frequency $f_p$ indicates $f_c \leq f_p < mf_c$ and $\zeta \leq 1$.

6. The design assistance method for the liquid ejection device according to claim 5, further comprising the steps of:

acquiring an estimated liquid consumption of the liquid ejection head; and calculating the pulsation frequency $f_p$ of the liquid pressure applying unit from the acquired estimated liquid consumption.

7. The design assistance method for the liquid ejection device according to claim 3, wherein the outputting step includes outputting the pulsation frequency $f_p$ that satisfies $f_c \leq f_p$ if it is determined in the determining step that $\zeta>1$ is satisfied, and outputting the pulsation frequency $f_p$ that satisfies $mf_c \leq f_p$ if it is determined in the determining step that $\zeta \leq 1$ is satisfied.

8. The design assistance method for the liquid ejection device according to claim 7, further comprising the steps of:

acquiring the flow channel configuration of the liquid ejection device; and calculating the compliance capacity C, the composite resistance R, and the composite inertance L, from the acquired flow channel configuration.

9. The design assistance method for the liquid ejection device according to claim 1, wherein the outputting step includes calculating and outputting a value satisfying the predetermined relationship for at least one of $f_c$, C, and L if it is determined in the determining step that the predetermined relationship is not satisfied.

10. The design assistance method for the liquid ejection device according to claim 1, wherein the pressure absorber includes a liquid chamber that communicates with the liquid supply flow channel; and a gas chamber that is separated from the liquid chamber with a partition wall deformable or movable for making a volume of the liquid chamber changeable.

11. The design assistance method for the liquid ejection device according to claim 1, wherein the liquid ejection device further includes a liquid recovering flow channel configured to recover the liquid from the liquid ejection head; and a second liquid pressure applying unit configured to apply pressure to the liquid in the liquid recovering flow channel through a second pressure absorber, the acquiring step includes acquiring a pulsation frequency $f_{p2}$ of the second liquid pressure applying unit, a compliance capacity $C_2$ of the second pressure absorber, and the composite inertance L of the liquid ejection head, the liquid supply flow channel, and the liquid recovering flow channel, and the determining step includes determining whether a relationship between a cutoff frequency $f_{c2}$ expressed by $f_{c2}=1/(2\pi(LC_2)^{0.5})$ using the acquired $C_2$ and L, and the pulsation frequency $f_{p2}$ satisfies a second relationship that satisfies $f_{p2}\geq f_{c2}$.

12. The design assistance method for the liquid ejection device according to claim 11, wherein the second relationship is a relationship of $f_{p2}\geq nf_{c2}$, where n is a constant greater than 1.

13. The design assistance method for the liquid ejection device according to claim 11, wherein the acquiring step includes acquiring the composite resistance R of the liquid ejection head and the liquid supply flow channel, and the predetermined relationship is a relationship as follows: $f_{c2}\leq f_{p2}\leq nf_{c2}$, where n is a constant greater than 1, and a damping term $\zeta_2$ expressed by $\zeta=0.5R\ (C2/L)^{0.5}$ and satisfying $\zeta_2>1$.

14. The design assistance method for the liquid ejection device according to claim 12, wherein n is 2.

15. The design assistance method for the liquid ejection device according to claim 13, further comprising the steps of:

acquiring the primary design of a flow channel configuration of the liquid ejection device; and calculating the compliance capacity $C_2$, the composite resistance R, and the composite inertance L from the acquired primary design of the flow channel configuration, and wherein the outputting step includes providing an output for urging at least one of values of the compliance capacity $C_2$ and the composite inertance L to be changed if it is determined in the determining step that the relationship between the cutoff frequency $f_{c2}$ and the pulsation frequency $f_{p2}$ indicates $f_{p2}<f_{c2}$, and providing an output for urging a value of the composite resistance R to be increased if it is determined in the determining step that the relationship between the cutoff frequency $f_{c2}$ and the pulsation frequency $f_{p2}$ indicates $f_{c2}\leq f_{p2}<nf_{c2}$, and $\zeta\leq 1$.

16. The design assistance method for the liquid ejection device according to claim 15, further comprising the steps of:

acquiring an estimated amount of recovered liquid of the liquid ejection head; and calculating the pulsation frequency $f_{p2}$ of the second liquid pressure applying unit from the acquired estimated amount of recovered liquid.

17. The design assistance method for the liquid ejection device according to claim 13, wherein the outputting step includes outputting the pulsation frequency $f_{p2}$ that satisfies $f_{c2}\leq f_{p2}$ if it is determined in the determining step that $\zeta_2>1$ is satisfied, and outputting the pulsation frequency $f_{p2}$ that satisfies $2f_{c2}\leq f_{p2}$ if it is determined in the determining step that $\zeta_2\leq 1$ is satisfied.

18. The design assistance method for the liquid ejection device according to claim 17, further comprising the steps of:

acquiring the flow channel configuration of the liquid ejection device; and calculating the compliance capacity $C_2$, the composite resistance R, and the composite inertance L, from the acquired flow channel configuration.

19. The design assistance method for the liquid ejection device according to claim 11, wherein the outputting step includes calculating and outputting a value satisfying the second relationship for at least one of $f_{c2}$, $C_2$, and L if it is determined in the determining step that the predetermined relationship is not satisfied.

20. The design assistance method for the liquid ejection device according to claim 11, wherein the second pressure absorber includes a second liquid chamber that communicates with the liquid recovering flow channel; and a second gas chamber that is separated from the second liquid chamber with a second partition wall deformable or movable for making a volume of the second liquid chamber changeable.

21. A non-transitory computer-readable recording medium storing a design support program of the liquid ejection device, the program allowing a computer to execute each of the steps of the design assistance method for the liquid ejection device according to claim 1.

22. A design assistance device for a liquid ejection device that satisfies a predetermined relationship and that includes a liquid ejection head provided with a nozzle for ejecting liquid; a liquid supply flow channel configured to supply the liquid to the liquid ejection head; and a liquid pressure applying unit configured to apply pressure to the liquid in the liquid supply flow channel through a pressure absorber, the design assistance device comprising:

an acquisition unit configured to acquire a pulsation frequency $f_p$ of the liquid pressure applying unit, a compliance capacity C of the pressure absorber, and a composite inertance L of the liquid ejection head and the liquid supply flow channel;

a determination unit configured to determine whether a relationship between a cutoff frequency $f_c$ expressed by $f_c=1/(2\pi(LC)^{0.5})$ using the acquired C and L, and the pulsation frequency $f_p$ satisfies the predetermined relationship that satisfies $f_p\geq f_c$; and an output unit configured to output a determination result of the determination unit.

23. A method of manufacturing a liquid ejection device that satisfies a predetermined relationship and that includes a liquid ejection head provided with a nozzle for ejecting liquid; a liquid supply flow channel configured to supply the liquid to the liquid ejection head; and a liquid pressure applying unit configured to apply pressure to the liquid in the liquid supply flow channel through a pressure absorber, the method comprising:

an acquiring step of acquiring a pulsation frequency $f_p$ of the liquid pressure applying unit, a compliance capacity C of the pressure absorber, and a composite inertance L of the liquid ejection head and the liquid supply flow channel;

a determining step of determining whether a relationship between a cutoff frequency $f_c$ expressed by $f_c=1/(2\pi(LC)^{0.5})$ using the acquired C and L, and the pulsation frequency $f_p$ satisfies the predetermined relationship that satisfies $f_p \geq f_c$, outputting the $f_p$, the C, and the L, if it is determined that the predetermined relationship is satisfied, and calculating and outputting a value satisfying the predetermined relationship for at least one of the $f_c$, the C, and the L if it is determined that the predetermined relationship is not satisfied; and a designing step of designing the liquid ejection device based on the output $f_c$, C, and L.

24. An image recording device comprising:

a liquid ejection device manufactured by the method of manufacturing a liquid ejection device according to claim 23;

a moving unit configured to relatively move the liquid ejection head and a recording medium; and a control unit configured to control the liquid to be ejected from the nozzle so that an image is formed on a recording surface of the recording medium while relatively moving the liquid ejection head and the recording medium.

* * * * *